US008400388B2

(12) United States Patent
Kim

(10) Patent No.: US 8,400,388 B2
(45) Date of Patent: Mar. 19, 2013

(54) LIQUID CRYSTAL DISPLAY

(75) Inventor: Junghwan Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1099 days.

(21) Appl. No.: 12/052,478

(22) Filed: Mar. 20, 2008

(65) Prior Publication Data

US 2009/0002304 A1 Jan. 1, 2009

(30) Foreign Application Priority Data

Jun. 28, 2007 (KR) ..... 10-2007-0064480

(51) Int. Cl.
*G09G 3/36* (2006.01)

(52) U.S. Cl. ..... 345/98; 345/100

(58) Field of Classification Search ..... 345/204, 345/90–100

See application file for complete search history.

(56) References Cited

U.S. PATENT DOCUMENTS

| | | | | |
|---|---|---|---|---|
| 5,712,652 | A * | 1/1998 | Sato et al. | 345/90 |
| 6,750,836 | B1 * | 6/2004 | Katayama et al. | 345/92 |
| 6,771,247 | B2 * | 8/2004 | Sato et al. | 345/98 |
| 2002/0024508 | A1 * | 2/2002 | Nakamura et al. | 345/204 |

FOREIGN PATENT DOCUMENTS

| | | |
|---|---|---|
| JP | 08-286170 | 11/1996 |
| JP | 2003-122331 | 4/2003 |
| KR | 10-2001-0023972 A | 3/2001 |
| KR | 10-2002-0059226 | 7/2002 |

OTHER PUBLICATIONS

KIPO Notice of Allowance dated Oct. 20, 2008 for corresponding Korean Application No. 10-2007-0064480.

KIPO Notice of Allowance dated Oct. 20, 2008, for Korean Patent application 10-2007-0064479, 4 pages.

* cited by examiner

*Primary Examiner* — Amr Awad
*Assistant Examiner* — Andre Matthews
(74) *Attorney, Agent, or Firm* — Christie, Parker & Hale, LLP

(57) ABSTRACT

A liquid crystal display including a data driver, a gate driver and a liquid crystal display panel having a plurality of pixels and a plurality of pixel memories. According to embodiments of the present invention, the pixels and the pixel memories are configured to reduce power consumption of pixels displaying still images and improve image quality of the liquid crystal display.

30 Claims, 10 Drawing Sheets

LIQUID CRYSTAL DISPLAY

CROSS-REFERENCE TO RELATED APPLICATIONS

This application claims priority to and the benefit of Korean Patent Application No. 10-2007-0064480, filed on Jun. 28, 2007, the entire content of which is incorporated herein by reference.

BACKGROUND

1. Field of the Invention

The present invention relates to a liquid crystal display, and more particularly, to liquid crystal display pixel and pixel memory.

2. Description of the Prior Art

Recently, with the development of an information-oriented society, electronic products such as personal computer, personal digital assistant (PDA), and others, have been widely used. Small sized and light-weight portable electronic products usable in an office or the outdoors have been required. To meet this requirement, a liquid crystal display (hereinafter referred to as "LCD") has been widely used. The liquid crystal display enables the portable electronic products to be small-sized and light-weight. Additionally, low power consumption of the portable electronic products can be realized by using the liquid crystal display as a display.

The LCD is mainly divided into a reflective type and a transmissive type according to a movement path of light. The reflective type liquid crystal displays an image by reflecting light entered from a front surface of a liquid crystal panel from a rear surface of the liquid crystal panel. The transmissive type LCD displays the image with transmissive light from a light source (i.e., backlight) located behind the rear surface of the liquid crystal panel. The reflective type LCD does not provide a constant amount of reflective light because of changing environmental conditions. Accordingly, visibility of the reflective type LCD is decreased when the environment is dim. As a result, a transmissive type color LCD using a color filter has been typically used as a display for devices such as a personal computer for displaying full-color images.

The LCD is mainly divided into a twisted nematic (TN) LCD and a super-twisted nematic (STN) LCD according to a driving method. The LCD can be driven by an active matrix display method using a switching element and the twisted nematic LCD, and a passive matrix display method using the super-twisted nematic LCD.

A color LCD is commonly driven by using the active matrix display method. A plurality of LCD cells are respectively included in the LCD panel of the active matrix LCD. A plurality of thin film transistors for switching a data voltage to be applied to each LCD cell are included in the LCD panel of the active matrix LCD. The LCD cells are located at positions where data lines and gate lines cross over. The thin film transistors are also located at the crossings. Display quality of the active matrix LCD is higher than that of the passive matrix LCD. However, the active matrix LCD dissipates high power to operate the thin film transistors of the LCD cells because a driver electrically coupled to the thin film transistors is operated to apply the voltage to the thin film transistors.

SUMMARY

Embodiments of the present invention provide a liquid crystal display that can reduce power consumption by storing a pixel voltage in a memory and driving a liquid crystal of a pixel located in an on screen display (OSD) region with the stored pixel voltage when a still image is displayed for a long period of time in the OSD region.

Embodiments of the present invention provide a liquid crystal display that can improve image deterioration by using a transmission gate to replace a single thin film transistor as an input/output switching element of a pixel memory to prevent voltage drop being produced by the single thin film transistor.

According to one embodiment of the invention, a liquid crystal display is provided. The liquid crystal display includes a data driver, a gate driver and a liquid crystal display panel having a plurality of pixels and a plurality of pixel memories. Each of the plurality of pixel memories includes a first inverter, a second inverter, a memory switching element, a first transmission gate and a second transmission gate. The first inverter includes a first input terminal and a first output terminal. The first inverter is configured to output a first output voltage opposite to a voltage received at the first input terminal. The second inverter includes a second input terminal and a second output terminal. The second inverter is configured to receive the first output voltage and output a second output voltage opposite to the first output voltage to the second output terminal. The memory switching element is electrically coupled between the first input terminal and the second output terminal. The first transmission gate is electrically coupled between the memory switching element and a pixel electrode. The second transmission gate is electrically coupled between the first output terminal and and the pixel electrode.

The first input terminal may be electrically coupled to a first electrode of the memory switching element, and the first output terminal may be electrically coupled to the second input terminal and a first electrode of the second transmission gate.

The first inverter may be configured to output the first output voltage opposite to a voltage received from the memory switching element so as to transfer the first output voltage to the second input terminal and the first electrode of the second transmission gate.

The second input terminal may be electrically coupled to the first output terminal and the first electrode of the second transmission gate, and the second output terminal may be electrically coupled to a second electrode of the memory switching element and a first electrode of the first transmission gate.

The second inverter may output the second output voltage opposite to a voltage received from the first inverter so as to transfer the second output voltage to the first electrode of the first transmission gate and the second electrode of the memory switching element.

The second inverter may output the second output voltage opposite to a voltage received from a first electrode of the second transmission gate so as to transfer the second output voltage to the second electrode of the memory switching element.

The memory switching element may include a control electrode electrically coupled to a gate line, a first electrode electrically coupled to the first input terminal of the first inverter, and a second electrode electrically coupled to a first electrode of the first transmission gate and the second output terminal.

The memory switching element may be configured to turn on when a gate voltage of a low level is applied to the control electrode through the gate line so as to transfer an output voltage from the first transmission gate to the first input terminal.

The memory switching element may be configured to turn on when a gate voltage of the low level is applied to the control electrode through the gate line so as to transfer the second output voltage from the second output terminal to the first input terminal.

The first transmission gate may include a first electrode electrically coupled to a second electrode of the memory switching element and the second output terminal, a first clock terminal electrically coupled to a first clock line, a second clock terminal electrically coupled to a first negative clock line, and the second electrode electrically coupled to the pixel electrode.

The first transmission gate may be configured to turn on when a first clock voltage of high level is applied to the first clock terminal through the first clock line and a first negative clock voltage of a low level is applied to the second clock terminal through the first negative clock line so as to transfer a pixel voltage applied from the pixel electrode to the memory switching element.

The first transmission gate may be configured to turn on when a first clock voltage of high level is applied to the first clock terminal through the first clock line and a first negative clock voltage of the low level is applied to the second clock terminal through the first negative clock line so as to transfer the second output voltage from the second output terminal to the pixel electrode.

The second transmission gate may include a first electrode electrically coupled to the first output terminal and the second input terminal, a first clock terminal electrically coupled to a second clock line, a second clock terminal electrically coupled to a second negative clock line, and a second electrode electrically coupled to the pixel electrode.

The second transmission gate may be configured to turn on when a second clock voltage of high level is applied to the first clock terminal through the second clock line and a second negative clock voltage of low level is applied to the second clock terminal through the second negative clock line so as to transfer a pixel voltage applied from the pixel electrode to the second input terminal.

The second transmission gate may be configured to turn on when a second clock voltage of high level is applied to the first clock terminal through the second clock line and a second negative clock voltage of low level is applied to the second clock terminal through the second negative clock line so as to transfer the first output voltage from the first output terminal to the pixel electrode.

Each of the plurality of pixels may include a liquid crystal cell, a capacitive element and a pixel switching element. The liquid crystal cell includes a first electrode electrically coupled to the pixel electrode and a second electrode electrically coupled to a common electrode. The capacitive element may be electrically coupled between the pixel electrode and the common electrode. The pixel switching element may be electrically coupled between the pixel electrode and a data line and may have a control electrode electrically coupled to a gate line. The first electrode of the liquid crystal cell may be electrically coupled to a second electrode of the first transmission gate and a second electrode of the second transmission gate via the pixel electrode. The second electrode of the liquid crystal cell may be electrically coupled to the common electrode.

The first electrode of the liquid crystal cell may include the pixel electrode, and the second electrode of the liquid crystal cell may include the common electrode.

The capacitive element may include a first electrode electrically coupled to a second electrode of the first transmission gate, a second electrode of the second transmission gate and the first electrode of the liquid crystal cell, and a second electrode electrically coupled to the common electrode and the second electrode of the liquid crystal cell.

The capacitive element may be configured to store an amount of charge corresponding to a voltage difference between the first electrode of the capacitive element and the second electrode of the capacitive element.

The pixel switching element may include the control electrode electrically coupled to the gate line, a first electrode electrically coupled to the data line, and a second electrode electrically coupled to the pixel electrode, the first electrode of the capacitive element and the first electrode of the liquid crystal cell.

The pixel switching element may be configured to turn on when a gate voltage of high level is applied to the control electrode through the gate line so as to transfer a data voltage applied from the data line to the pixel electrode.

The memory switching element can be configured to turn off when the pixel switching element is turned on, and the memory switching element can be configured to turn on when the pixel switching element is turned off.

According to another embodiment of the invention, a liquid crystal display is provided. The liquid crystal display includes a data driver, a gate driver and a liquid crystal display panel having a plurality of pixels and a plurality of pixel memories. Each of the plurality of pixel memories includes a first NAND gate, a second NAND gate, a memory switching element, a first transmission gate and a second transmission gate. The first NAND gate includes a first input terminal electrically coupled to a first power voltage line to output a first output voltage opposite to a first input voltage received at its second input terminal to its output terminal. The second NAND gate includes a first input terminal electrically coupled to the first power voltage line and is configured to apply the first output voltage to a second input terminal of the second NAND gate to output a second output voltage opposite to the first output voltage to its output terminal. The memory switching element is electrically coupled between the second input terminal of the first NAND gate and the output terminal of the second NAND gate. The first transmission gate is electrically coupled between the memory switching element and a pixel electrode. The second transmission gate is electrically coupled between the pixel electrode and the output terminal of the first NAND gate.

The first NAND gate may includes the first input terminal electrically coupled to the first power voltage line, the second input terminal electrically coupled to a first electrode of the memory switching element, and the output terminal electrically coupled to the second input terminal of the second NAND gate and a first electrode of the second transmission gate.

The second NAND gate may includes the first input terminal electrically coupled to the first power voltage line, the second input terminal electrically coupled to the output terminal of the first NAND gate and a first electrode of the second transmission gate, and an output terminal electrically coupled to a first electrode of the first transmission gate and a second electrode of the memory switching element.

The memory switching element may include a control electrode electrically coupled to a gate line, a first electrode electrically coupled to the second input terminal of the first NAND gate, and a second electrode electrically coupled to the output terminal of the second NAND gate and a first electrode of the first transmission gate.

The first transmission gate may include a first electrode electrically coupled to a second electrode of the memory switching element and the output terminal of the second NAND gate, a first clock terminal electrically coupled to a first clock line, a second clock terminal electrically coupled to a first negative clock line, and a second electrode electrically coupled to the pixel electrode.

The second transmission gate may include a first electrode electrically coupled to the output terminal of the first NAND gate and the second input terminal of the second NAND gate, a first clock terminal electrically coupled to a second clock line, a second clock terminal electrically coupled to a second negative clock line, and a second electrode electrically coupled to the pixel electrode.

Each of the plurality of pixels may include a liquid crystal cell, a capacitive element and a pixel switching element. The liquid crystal cell includes a first electrode electrically coupled to the pixel electrode and a second electrode electrically coupled to a common electrode. The capacitive element may be electrically coupled between the pixel electrode and the common electrode. The pixel switching element may be electrically coupled between the pixel electrode and a data line, and may have a control electrode electrically coupled to the gate line.

According to still another embodiment of the invention, a liquid crystal display is provided. The liquid crystal display includes a data driver, a gate driver and a liquid crystal display panel having a plurality of pixels and a plurality of pixel memories. Each of the plurality of pixel memories includes a first NOR gate, a second NOR gate, a memory switching element, a first transmission gate and a second transmission gate. The first NOR gate includes a first input terminal electrically coupled to a ground and is configured to output a first output voltage opposite to a first input voltage received at its second input terminal. The second NOR gate includes a first input terminal electrically coupled to the ground and is configured to receive the first output voltage at its second input terminal to output a second output voltage opposite to the first output voltage to its output terminal. The memory switching element is electrically coupled between the second input terminal of the first NOR gate and the output terminal of the second NOR gate. The first transmission gate is electrically coupled between the memory switching element and a pixel electrode. The second transmission gate is electrically coupled between the pixel electrode and an output terminal of the first NOR gate.

The first NOR gate may include the first input terminal electrically coupled to the ground, the second input terminal electrically coupled to a first electrode of the memory switching element, and the output terminal electrically coupled to the second input terminal of the second NOR gate and a first electrode of the second transmission gate.

The second NOR gate may include the first input terminal electrically coupled to the ground, the second input terminal electrically coupled to the output terminal of the first NOR gate and a first electrode of the second transmission gate, and the output terminal electrically coupled to a first electrode of the first transmission gate and a second electrode of the memory switching element.

The memory switching element may include a control electrode electrically coupled to a gate line, a first electrode electrically coupled to the second input terminal of the first NOR gate, and a second electrode electrically coupled to the output terminal of the second NOR gate and a first electrode of the first transmission gate.

The first transmission gate may include a first electrode electrically coupled to a second electrode of the memory switching element and the output terminal of the second NOR gate, a first clock terminal electrically coupled to a first clock line, a second clock terminal electrically coupled to a first negative clock line, and a second electrode electrically coupled to the pixel electrode.

The second transmission gate may include a first electrode electrically coupled to the output terminal of the first NOR gate and the second input terminal of the second NOR gate, a first clock terminal electrically coupled to a second clock line, a second clock terminal electrically coupled to a second negative clock line, and a second electrode electrically coupled to the pixel electrode.

Each of the plurality of pixels may include a liquid crystal cell, a capacitive element and a pixel switching element. The liquid crystal cell may include a first electrode electrically coupled to the pixel electrode and a second electrode electrically coupled to a common electrode. The capacitive element may be electrically coupled between the pixel electrode and the common electrode. The pixel switching element may be electrically coupled between the pixel electrode and a data line, and may be configured to electrically couple a control electrode to a gate line.

BRIEF DESCRIPTION OF THE DRAWINGS

The above and other features and aspects of the embodiments of the present invention will be more apparent from the following detailed description taken in conjunction with the accompanying drawings, in which.

DETAILED DESCRIPTION OF EXEMPLARY EMBODIMENTS

Figure 1:
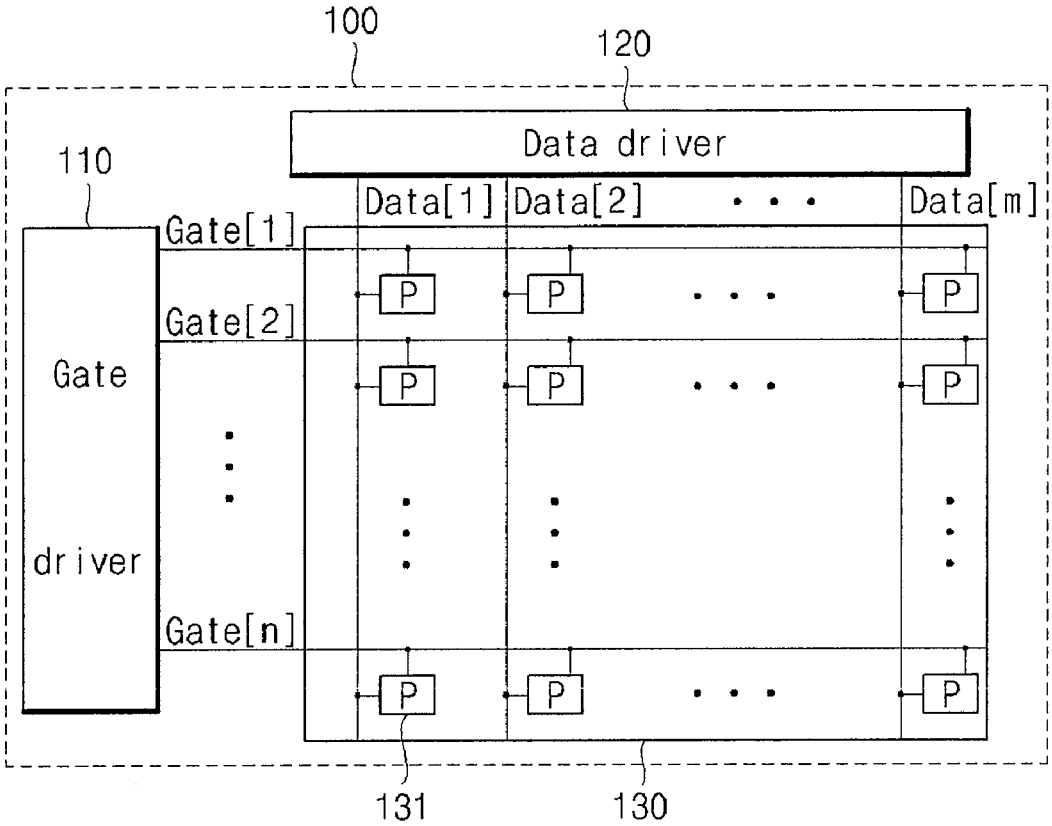
FIG. 1 is a block diagram illustrating a liquid crystal display according to one exemplary embodiment of the present invention.

Hereinafter, exemplary embodiments of the present invention will be described in detail with reference to the accompanying drawings. The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are specific details provided to assist those of ordinary skill in the art in a comprehensive understanding of the invention, but the present invention is not limited thereto. The present invention is defined by the scope of the appended claims and their equivalents. In the entire description of the present invention, the same drawing reference numerals are used for the same elements across various figures.

FIG. 1 is a block diagram illustrating a liquid crystal display (LCD) according to one exemplary embodiment of the present invention.

Referring to FIG. 1, an LCD 100 includes a gate driver 110, a data driver 120 and a liquid crystal display panel 130.

The gate driver 110 sequentially supplies a gate voltage to the LCD panel 130 via a plurality of gate lines (Gate[1], Gate[2], . . . , Gate[n]).

The data driver 120 sequentially supplies a data voltage to the LCD panel 130 via a plurality of data lines (Data[1], Data[2], . . . , Data[m]).

The LCD panel 130 includes the plurality of gate lines (Gate[1], Gate[2], . . . , Gate[n]) extending in horizontal direction, the plurality of data lines (Data[1], Data[2], . . . , Data[m]) extending in vertical direction, and a plurality of pixel circuits 131 that are defined by the plurality of gate lines (Gate[1], Gate[2], . . . , Gate[n]) and data lines (Data[1], Data[2], . . . , Data[m]).

A pixel circuit 131 of the plurality of pixel circuits are formed on a pixel region that is defined by two neighboring gate lines and two neighboring data lines. As described above, the gate voltage are supplied to the gate lines (Gate[1], Gate [2], Gate[n]) from the gate driver 110, and the data voltage are supplied to the data lines (Data[1], Data[2], . . . , Data[m]) from the data driver 120. The pixel circuit 131 includes a pixel and a pixel memory. The pixel will be explained in detail with reference to FIG. 2, and the pixel memory will be explained in detail with reference to FIGS. 3 to 8.

Figure 2:
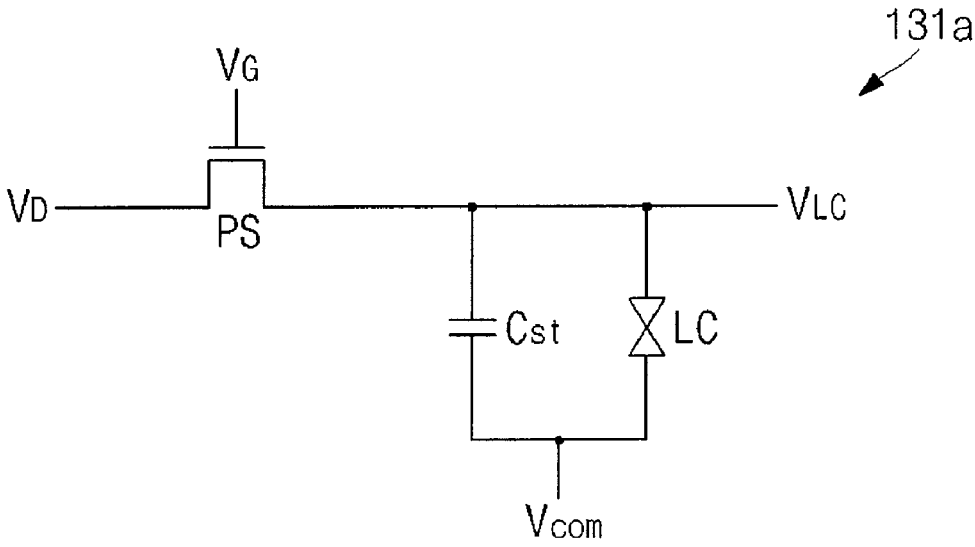
FIG. 2 is a circuit diagram illustrating a pixel of the liquid crystal display according to one exemplary embodiment of the present invention.

FIG. 2 is a circuit diagram illustrating a pixel 131*a* of the LCD according to an exemplary embodiment of the present invention;

Referring to FIG. 2, the pixel 131*a* of the LCD includes a pixel switching element (PS), a liquid crystal (LC) cell and a capacitive element ($C_{st}$).

The pixel switching element (PS) includes a gate electrode electrically coupled to the gate lines (Gate[1], Gate[2], . . . , Gate[n]), a first electrode ($V_D$) (e.g., drain electrode or source electrode) electrically coupled to a data line (e.g., Data[1], Data[2], . . . , Data[m]), and a second electrode (e.g., drain electrode or source electrode) electrically coupled to a pixel electrode ($V_{LC}$). If a gate voltage of high level is applied to the gate electrode, the pixel switching element (PS) is turned on so as to transfer a data voltage applied to the a data line (e.g., Data[1], Data[2], . . . , Data[m]) to the pixel electrode ($V_{LC}$).

The liquid crystal (LC) cell includes a first electrode electrically coupled to the pixel electrode ($V_{LC}$), and a second electrode electrically coupled to the common electrode (Vcom). When the data voltage is applied to the pixel electrode ($V_{LC}$) and a common voltage is applied to the common electrode ($V_{COM}$), the liquid crystal (LC) cell controls an amount of light passing through the liquid crystal while an array of liquid crystal molecules is changed by an electric field or blocks the light.

The capacitive element ($C_{st}$) includes a first electrode electrically coupled to the pixel electrode ($V_{LC}$), and a second electrode electrically coupled to the common electrode ($V_{COM}$). In other words, the capacitive element ($C_{st}$) is connected in parallel to the liquid crystal (LC) cell. The capacitive element ($C_{st}$) is charged with an amount of electric charge corresponding to a voltage difference between the pixel electrode ($V_{LC}$) and the common electrode ($V_{COM}$) when the pixel switching element (PS) is turned on so as to apply the data voltage to the pixel electrode ($V_{LC}$). The amount of electric charge charged in the capacitive element ($C_{st}$) is supplied to the pixel electrode ($V_{LC}$) while the pixel switching element (PS) is turned off by applying a low level gate voltage to the gate electrode of the pixel switching element (PS) so as to maintain the driving of the liquid crystal (LC) cell. An amount of charge retained by the capacitive element ($C_{st}$) is decided by the voltage difference between the pixel electrode ($V_{LC}$) and the common electrode ($V_{COM}$).

Figure 3:
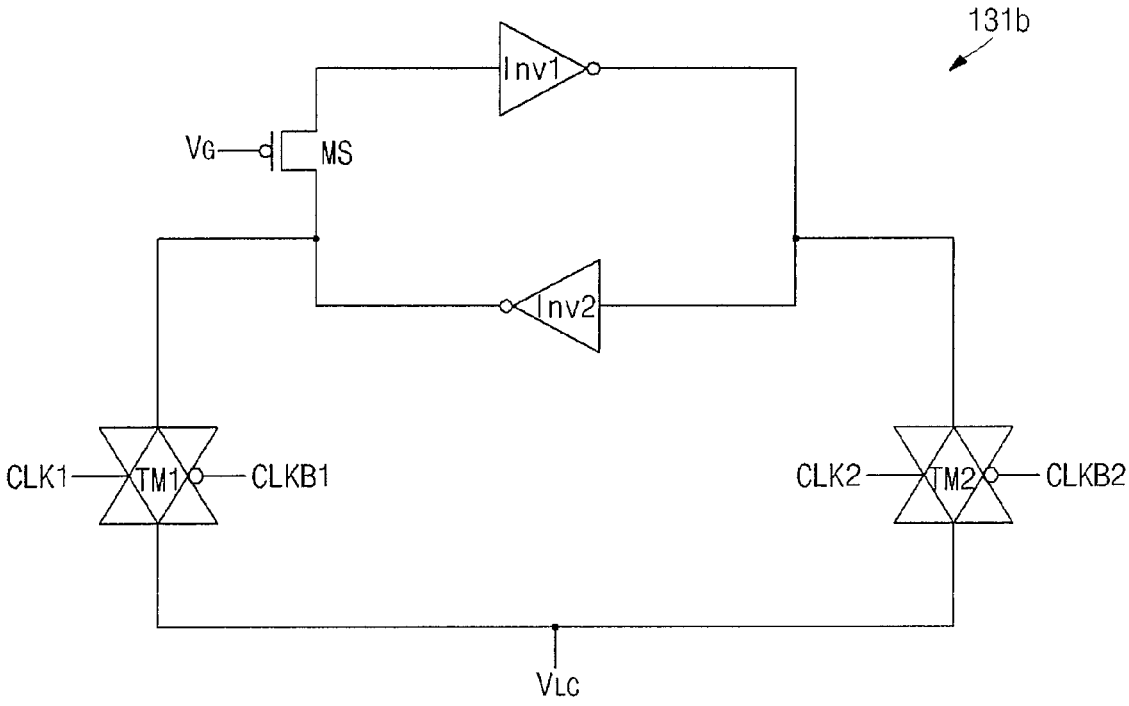
FIG. 3 is a circuit diagram illustrating a pixel memory of the liquid crystal display according to one exemplary embodiment of the present invention.

FIG. 3 is a circuit diagram illustrating a pixel memory 131*b* of the liquid crystal display according to one exemplary embodiment of the present invention.

Referring to FIG. 3, the pixel memory 131*b* of the LCD includes a first inverter (Inv1), a second inverter (Inv2), a memory switching element (MS), a first transmission gate (TM1) and a second transmission gate (TM2).

A gate line electrically coupled to a control electrode of the memory switching element (MS) is electrically coupled to the control electrode of the pixel switching element (PS) of FIG. 2. The pixel electrode ($V_{LC}$) between the first transmission gate (TM1) and the second transmission gate (TM2) is the same as the pixel electrode ($V_{LC}$) between the liquid crystal (LC) cell and the capacitive element (Cst) shown in FIG. 2. In other words, the pixel 131*a* of FIG. 2 and the pixel memory 131*b* of FIG. 3 are electrically coupled to each other.

The memory switching element (MS) shown as a P-channel metal oxide semiconductor (PMOS) transistor is turned one when a voltage of low level is applied to a control electrode, and the pixel switching element (PS) shown as an N-channel metal oxide semiconductor (NMOS) in FIG. 2 is turned on when a voltage of high level is applied to the control electrode; however, the present invention is not limited thereto. If the memory switching element (MS) is an NMOS transistor, the pixel switching element (PS) becomes a PMOS transistor; and when the memory switching element (MS) is a PMOS transistor, the pixel switching element (PS) becomes an NMOS transistor. Accordingly, when the gate voltage is applied to the gate line from the control electrode, the pixel switching element (PS) and the memory switching element (MS) are operated in opposite states.

The pixels 131*a* and the pixel memories 131*b* of the plurality of pixels 131 display a still image for a long period of time. While the pixel 131*a* in an OSD region is not operated, the corresponding pixel memory 131*b* is operated. The pixel memory 131*b* inputs/outputs the pixel voltage to/from the pixel electrode ($V_{LC}$) to operate the liquid crystal (LC) cell. Here, since the pixel 131*a* of FIG. 2 is not operated when the pixel is in the OSD region, the drivers, except the gate driver 110, electrically coupled to the pixel 131*a* are not operated, thereby allowing the power consumption of the LCD to be reduced.

The first inverter (Inv1) includes an input terminal electrically coupled to the first electrode of the memory switching element (MS), and an output terminal electrically coupled to an input terminal of the second inverter (Inv2) and a first electrode of the second transmission gate (TM2).

The first inverter (Inv1) outputs a voltage opposite to a voltage transferred from the memory switching element (MS) so as to transfer the opposite voltage to the input terminal of the second inverter (Inv2) and the first electrode of the second transmission gate (TM2). In other words, if the voltage of high level is applied to the input terminal, the voltage of low level is outputted to the output terminal, and if the voltage of low level is applied to the input terminal, the voltage of high level is outputted to the output terminal. The outputted voltages are transferred to the input terminal of the second inverter (Inv2) and first electrode of the second transmission gate (TM2).

The second inverter (Inv2) includes an input terminal electrically coupled between the output terminal of the first inverter (Inv1) and the first electrode of the second transmission gate (TM2), and an output terminal electrically coupled to the second electrode of the memory switching element (MS) and the first electrode of the first transmission gate (TM1).

The second inverter (Inv2) outputs a voltage opposite to the voltage outputted from the output terminal of the first inverter (Inv1) so as to transfer the outputted voltage to the second electrode of the memory switching element (MS) and the first electrode of the first transmission gate (TM1). In other words, the second inverter (Inv2) outputs the voltage of low level to the output terminal when the voltage of high level is applied to the input terminal, and the voltage of high level is outputted to the output terminal when the voltage of low level is applied to the input terminal so as to transfer the outputted voltage to the second electrode of the memory switching element (MS) and the first electrode of the first transmission gate (TM1). The second inverter (Inv2) outputs a voltage opposite to the pixel voltage transferred through the second transmission gate (TM2) so as to transfer the outputted voltage to the second electrode of the memory switching element (MS). In other words, the second inverter (Inv2) outputs the voltage of low level to the output terminal when the pixel voltage of high level is applied to the input terminal, and outputs the voltage of high level to the output terminal when the pixel voltage of low level is applied to the input terminal so as to transfer the outputted voltage to the second electrode of the memory switching element (MS).

When the memory switching element (MS) between the first inverter (Inv1) and the second inverter (Inv2) is turned on, the voltage between the first inverter (Inv1) and the second inverter (Inv2) is changed from high level to low level and vice versa, whenever it passes through the inverters Inv1 and Inv2. For example, if the voltage of high level is applied to the input terminal of the first inverter (Inv1), the voltage of low level is outputted so as to be applied to the input terminal of the second inverter (Inv2), and the second inverter (Inv2) outputs the voltage of high level to the output terminal so as to apply the outputted voltage to the first inverter (Inv1). As a result, the voltage is alternately applied.

The memory switching element (MS) includes a control electrode (e.g., gate electrode) electrically coupled to the gate line, a first electrode electrically coupled to the input terminal of the first inverter (Inv1), and a second electrode electrically coupled to the output terminal of the second inverter (Inv2) and the first electrode of the first transmission gate (TM1).

The gate line is the same as the gate line applied to the pixel 131*a* (shown in FIG. 2) of the LCD. Accordingly, the same gate voltage applied to the control electrode of the pixel switching element (PS) of the pixel 131*a* is applied to the control electrode of the memory switching element (MS). The memory switching element (MS) is turned on when the gate voltage of low level is applied to the control electrode, so that the voltage outputted from the output terminal of the second inverter (Inv2) is transferred to the input terminal of the first inverter (Inv1). In other words, if the first transmission gate (TM1) is turned on, the memory switching element (MS) transfers the pixel voltage transferred from the first transmission gate (TM1) to the input terminal of the first inverter (Inv1). If the first transmission gate (TM1) is turned off, the voltage between the first inverter (Inv1) and the second inverter (Inv2) is continuously alternated.

The first transmission gate (TM1) includes a first electrode electrically coupled to the second electrode of the memory switching element (MS) and the output terminal of the second inverter (Inv2), a second electrode electrically coupled to the pixel electrode ($V_{LC}$), a first clock terminal electrically coupled to the first clock line (CLK1), and a second clock terminal electrically coupled to the first negative clock line (CLKB1).

The pixel electrode ($V_{LC}$) is electrically coupled to the pixel 131*a* (shown in FIG. 2) of the LCD to apply the pixel voltage to the pixel electrode ($V_{LC}$). The first transmission gate (TM1) is turned on when the first clock voltage of high level and the first negative clock voltage of low level are applied, so that the pixel voltage applied from the pixel electrode ($V_{LC}$) is transferred to the memory switching element (MS), and the voltage transferred from the output terminal of the second inverter (Inv2) is applied to the pixel electrode ($V_{LC}$). In other words, the pixel voltage is inputted and outputted to/from the pixel electrode ($V_{LC}$).

When the first clock voltage applied from the first clock line (CLK1) is high level, the first negative clock voltage applied through the first negative clock line (CLKB1) becomes low level, and when the first clock voltage is low level, the first negative clock voltage becomes high level. When the first clock voltage is high level, and the first negative clock voltage is low level, the transmission gate is turned on (i.e., enable voltage).

The first transmission gate (TM1) can prevent or reduce voltage drop caused by single transistor. For example, when only an N-type transistor is used, the N-type transistor is turned on by applying the voltage of high level to the gate electrode so as to output the voltage applied to the first electrode to the second electrode. Here, if a voltage value applied to the first electrode is high level, the voltage drop is produced by a threshold voltage of the N-type transistor. For another example, when only a P-type transistor is used, the P-type transistor is turned on by applying the voltage of low level to the gate electrode, the voltage applied to the first electrode is outputted to the second electrode. Here, if the voltage applied to the first electrode is low level, the voltage drop is produced by the threshold voltage of the P-type transistor.

In one embodiment, the first transmission gate (TM1) includes a P-type transistor and an N-type transistor. The first electrodes of the transistors are electrically coupled together, and the second electrodes of the transistors are electrically coupled together. If a high level voltage is applied to the control electrode of the N-type transistor and a low level voltage is applied to the control electrode of the P-type transistor, the first transmission gate (TM1) is turned on. If the first transmission gate (TM1) is turned on, the input voltage of high level is transferred to the second electrode through the P-type transistor, and the input voltage of low level is transferred to the second electrode through the N-type transistor, thereby allowing the voltage drop across the first transmission gate (TM1) to be prevented or reduced.

The second transmission gate (TM2) includes a first electrode electrically coupled to the output terminal of the first inverter (Inv1) and the input terminal of the second inverter (Inv2), a second electrode electrically coupled to the pixel electrode ($V_{LC}$), a first clock terminal electrically coupled to the second clock line (CLK2), and a second clock terminal electrically coupled to the second negative clock line (CLKB2).

The pixel electrode ($V_{LC}$) is electrically coupled to the pixel electrode ($V_{LC}$) of the pixel 131*a* (shown in FIG. 2) of the LCD to apply the pixel voltage to the pixel electrode ($V_{LC}$) of the liquid crystal (LC) cell. The second transmission gate (TM2) is turned on when the second clock voltage of high level and the second negative clock voltage of low level are applied, so that the pixel voltage applied from the pixel electrode ($V_{LC}$) is transferred to the input terminal of the second inverter (Inv2), and the pixel voltage applied from the output terminal of the first inverter (Inv1) is transferred to the pixel electrode ($V_{LC}$). In other words, the pixel voltage is inputted to/outputted from the pixel electrode ($V_{LC}$).

When the second clock voltage applied from the second clock line (CLK2) is high level, the second negative clock voltage applied through the second negative clock line (CLKB2) becomes low level. When the second clock voltage is low level, the second negative clock voltage becomes high level. When the second clock voltage is high level and the second negative clock voltage is low level, the second transmission gate (TM2) is turned on (i.e., enabled).

The use of the second transmission gate (TM2) can prevent or reduce voltage drop caused by the use of a single transistor. When an N-type transistor is turned on so as to output the voltage applied to the first electrode to the second electrode, a high level voltage is applied to the gate electrode. Here, if the voltage applied to the first electrode is high level, the voltage drop is produced by the threshold voltage of the N-type transistor. When the P-type transistor is turned on so as to output the voltage applied to the first electrode to the second electrode, a voltage of low level is applied to the gate electrode. Here, if the voltage applied to the first electrode is low level, the voltage drop is produced by the threshold voltage of the P-type transistor.

In one embodiment, the second transmission gate (TM2) includes a P-type transistor and an N-type transistor. The first electrodes of the transistors are electrically coupled together, and the second electrodes of the transistors are electrically coupled together. If a high level voltage is applied to the control electrode of the N-type transistor and a low level voltage is applied to the control electrode of the P-type transistor, the second transmission gate (TM2) is turned on. When the second transmission gate (TM2) is turned on, the input voltage of high level is transferred to the second electrode through the P-type transistor, and the input voltage of low level is transferred to the second electrode through the N-type transistor, thereby allowing the voltage drop across the second transmission gate (TM2) to be prevented or reduced.

Figure 4A:
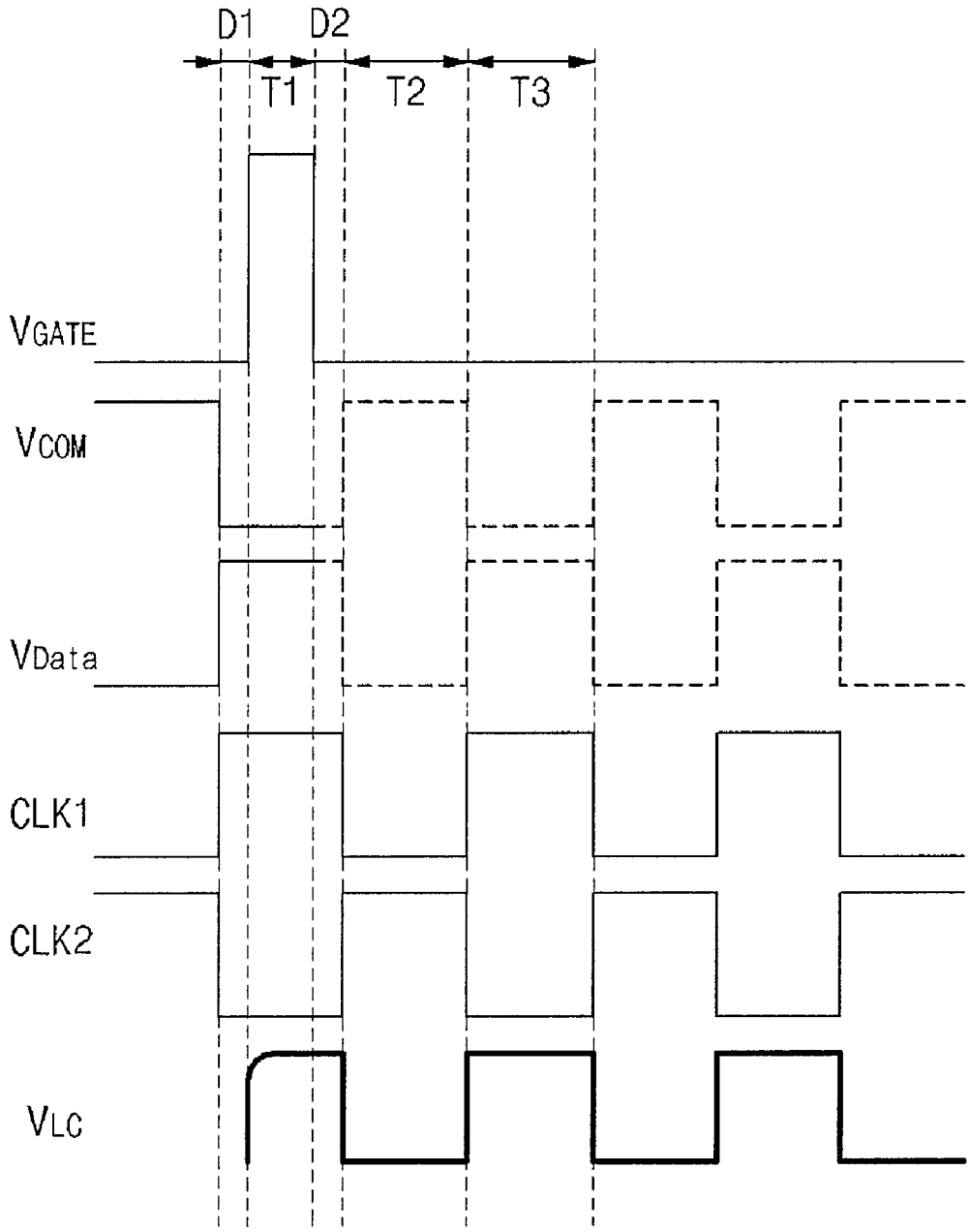
FIGS. 4*a* and 4*b* are timing diagrams of the pixel and the pixel memory of the liquid crystal display shown in FIGS. 2 and 3, respectively.
Figure 4B:
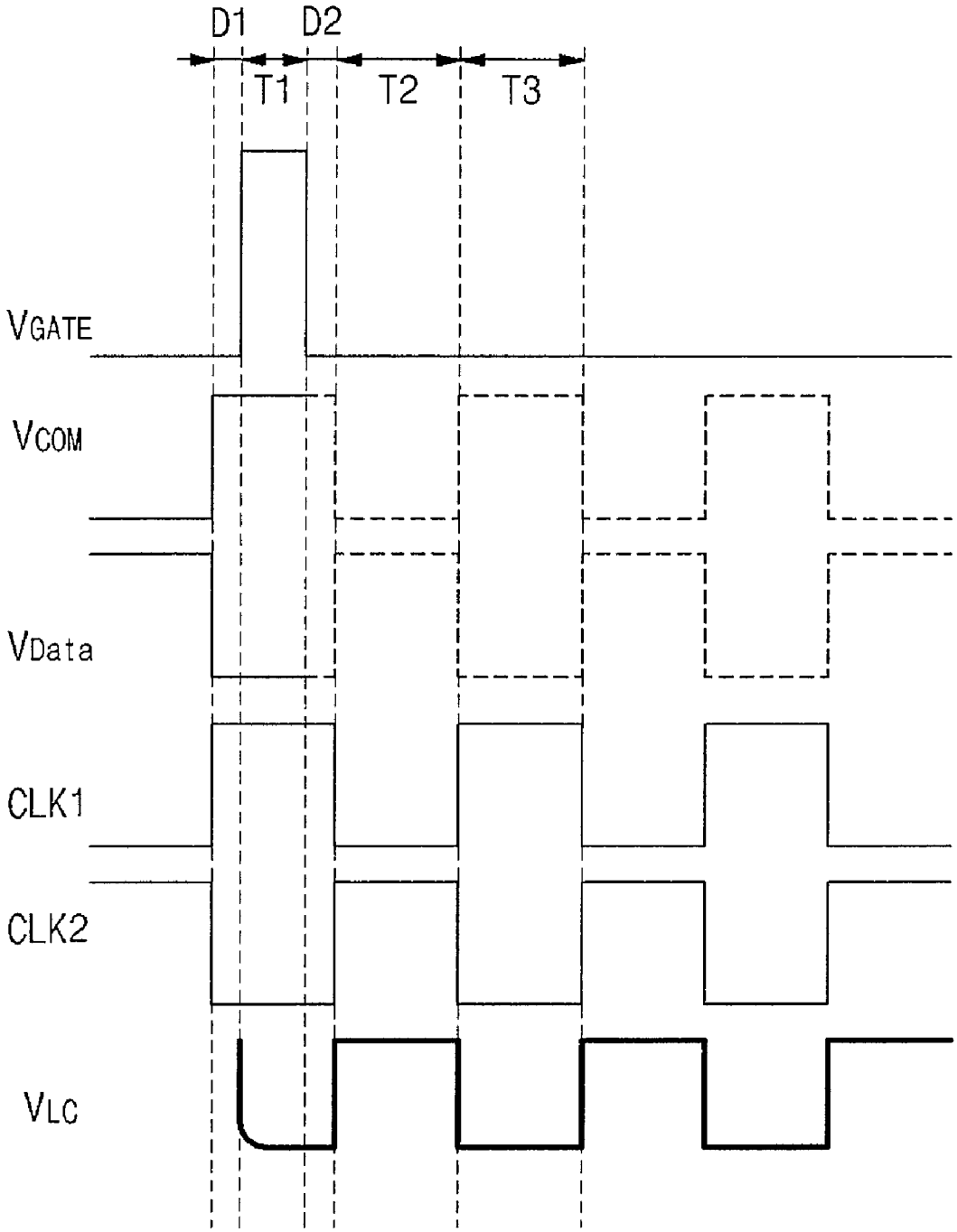

FIGS. 4*a* and 4*b* are the timing diagrams of the pixel and the pixel memory of the liquid crystal display shown in FIGS. 2 and 3, respectively.

Referring to FIG. 4*a*, the timing diagram of the pixel 131*a* and the pixel memory 131*b* includes a first driving period (T1), a second driving period (T2) and a third driving period (T3), and may additionally include a first delay period (D1) and a second delay period (D2).

First, in the first delay period (D1), the gate voltage ($V_{GATE}$) of low level is applied to the pixel 131*a* and the pixel memory 131*b*, the common voltage ($V_{com}$) of low level and the data voltage ($V_{DATA}$) of high level are applied to the pixel 131*a*, and the first clock voltage of high level and the second clock voltage of low level are applied to the pixel memory 131*b*.

In the first delay period (D1), the pixel 131*a* is turned off by applying the gate voltage ($V_{GATE}$) of low level to the control electrode of the pixel switching element (PS), and the pixel memory 131*b* is turned on by applying the gate voltage ($V_{GATE}$) of low level to the control electrode of the memory switching element (MS). The first transmission gate (TM1) of the pixel memory 131*b* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second clock terminal.

In the first delay period (D1), the common voltage ($V_{com}$) and the data voltage ($V_{DATA}$) are constantly maintained prior to the first driving period (T1). The first delay period (D1) is a period that the gate voltage ($V_{GATE}$) is changed from low level to high level. This can assure clock skew margin or delay margin.

In the first driving period (T1), the gate voltage ($V_{GATE}$) of high level is applied to the pixel 131*a* and the pixel memory 131*b*, the common voltage ($V_{com}$) of low level and the data voltage ($V_{DATA}$) of high level is applied to the pixel 131*a*, and the first clock voltage of high level and the second clock voltage of low level are applied to the pixel memory 131*b*.

The pixel switching element (PS) of the pixel 131*a* is turned on by applying the gate voltage ($V_{GATE}$) of high level. The pixel switching element (PS) is turned on so as to transfer the data voltage ($V_{DATA}$) of high level applied from the first electrode to the pixel electrode ($V_{LC}$). Here, across the liquid crystal (LC) cell and the capacitive element ($C_{st}$), the data voltage ($V_{DATA}$) of high level is applied via the pixel electrode ($V_{LC}$), and the common voltage ($V_{com}$) of low level is applied via the common electrode ($V_{com}$). As the result thereof, the liquid crystal (LC) cell controls a light transmission rate by changing an array state of liquid crystal cells according to horizontal electric field formed by a voltage difference between both electrodes (i.e., the pixel electrode and the common electrode) in order to realize a gray level, and the capacitive element ($C_{st}$) stores the voltage difference between the pixel electrode ($V_{LC}$) and the common electrode (Vcom).

The first transmission gate (TM1) of the pixel memory 131*b* is turned on by applying the first clock voltage of high level to the first clock terminal and applying the first negative clock voltage of low level to the second clock terminal, so that the data voltage ($V_{DATA}$) of high level applied to the pixel electrode ($V_{LC}$) is applied to the second electrode of the memory switching element (MS). The memory switching element (MS) is turned off by applying the gate voltage ($V_{GATE}$) of high level.

In the second delay period (D2), the gate voltage ($V_{GATE}$) of low level is applied to the pixel 131*a* and the pixel memory 131*b*, and the first clock voltage of high level and the second clock voltage of low level are applied to the pixel memory 131*b*. The pixel 131*a* is turned off by applying the gate voltage ($V_{GATE}$) of low level to the control electrode of the pixel switching element (PS).

The pixel memory 131*b* is turned on by applying the gate voltage ($V_{GATE}$) Of low level to the control electrode of the memory switching element (MS). The first transmission gate (TM1) of the pixel memory 131*b* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second clock terminal. The memory switching element (MS) and the first transmission gate (TM1) of the pixel memory 131*b* is turned on so that the data voltage ($V_{DATA}$) of high level applied to the pixel electrode ($V_{LC}$) is applied to the input terminal of the first inverter (Inv1) to output the voltage of low level. The second inverter (Inv2) receives the voltage of low level to output the voltage of high level. The voltage outputted from the second inverter (Inv2) is applied to the first inverter (Inv1). In other words, the voltage between the first inverter (Inv1) and the second inverter (Inv2) is changed alternately between low level and high level. The pixel voltage of high level outputted to the output terminal of the second inverter (Inv2) is outputted to the pixel electrode ($V_{LC}$).

Here, the second clock voltage is applied to the common electrode by electrically coupling to the second clock line (CLK2) with the same voltage value of low level as the common voltage ($V_{com}$) in the first delay period (D1). The pixel voltage of high level is applied to the pixel electrode ($V_{LC}$) and the second clock voltage of low level is applied to the common electrode (Vcom). The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. When the pixel 131*a* is turned off, the common voltage and the data voltage of the pixel 131*a* are not applied to the pixel 131*a*, and the liquid crystal (LC) cell is operated by the pixel memory 131*b*. The liquid crystal (LC) cell of the pixel 131*a* can be operated without applying the common voltage and the data voltage, thereby allowing the power consumption of the circuits operating the driver to be reduced. Accordingly, the total power consumption of the LCD can be reduced. After the second delay period (D2), the pixel 131*a* is not operated (i.e., the pixel switch element is turned off), and the liquid crystal (LC) cell is operated by outputting a voltage to be applied to the pixel electrode from the pixel memory 131*b*. The second delay period (D2) is a period of inputting and outputting the voltage from the pixel electrode ($V_{LC}$) to the pixel memory 131*b*.

In the second driving period (T2), the gate voltage ($V_{GATE}$) of low level through the gate line is applied to the pixel 131*a* and the pixel memory 131*b*, and the first clock voltage of low level through the first clock line (CLK1) and the second clock voltage of high level through the second clock line (CLK2) is applied to the pixel memory 131*b*. Here, the pixel switching element (PS) of the pixel 131*a* is turned off by applying the gate voltage ($V_{GATE}$) of low level to the control electrode, and thus the pixel 131*a* is not operated.

The memory switching element (MS) of the pixel memory 131*b* is turned on by applying the gate voltage ($V_{GATE}$) of low level to the control electrode. The first transmission gate (TM1) of the pixel memory 131*b* is turned off by applying the first clock voltage of low level to the first clock terminal and applying the first negative clock voltage of high level to the second clock terminal. The second transmission gate (TM2) is turned on by applying the second clock voltage of high level to the first clock terminal and applying the second negative clock voltage of low level to the second clock terminal. The second transmission gate (TM2) of the pixel memory 131*b* is turned on to output the pixel voltage of low level outputted to the output terminal of the first inverter (Inv1) to the pixel electrode ($V_{LC}$) through the second transmission gate (TM2) while low level and high level are changed between the first inverter (Inv1) and the second inverter (Inv2). Also, the memory switching element (MS) of the pixel memory 131*b* is turned on. Accordingly, the voltage between the first inverter (Inv1) and the second inverter (Inv2) are continuously alternated between low level and high level. In other words, the pixel voltage of low level is applied to the input terminal of the second inverter (Inv2) so as to output the pixel voltage of high level and apply the outputted pixel voltage to the first inverter (Inv1). The first inverter (Inv1) outputs the pixel voltage of low level by receiving the pixel voltage of high level as input and applies the outputted pixel voltage to the second inverter (Inv2).

Here, the common electrode (Vcom) is electrically coupled to the second clock line (CLK2) with the same voltage value as the common voltage ($V_{com}$) in the first delay period (D1), the first driving period (T1) and the second delay period (D2) so as to apply the second clock voltage. The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. The second driving period (T2) is a period for outputting the voltage from the pixel memory 131*b* to the pixel electrode ($V_{LC}$).

Finally, in the third driving period (T3), the gate voltage ($V_{GATE}$) of low level through the gate line is applied to the pixel 131*a* and the pixel memory 131*b*, and the first clock voltage of high level through the first clock line (CLK1) and the second clock voltage of low level through the second clock line (CLK2) are applied to the pixel memory 131*b*. Here, the pixel switching element (PS) of the pixel 131*a* is turned off by applying the gate voltage ($V_{GATE}$) of low level to the control electrode, and thus the pixel 131*a* is not operated.

The memory switching element (MS) of the pixel memory 131*b* is turned on by applying the gate voltage ($V_{GATE}$) of low level to the control electrode. The first transmission gate (TM1) of the pixel memory 131*b* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second negative clock terminal. The first transmission gate (TM1) of the pixel memory 131*b* is turned on to output the pixel voltage of high level outputted to the output terminal of the second inverter (Inv2) to the pixel electrode ($V_{LC}$) through the first transmission gate (TM1) while low level voltage and high level voltage are changed between the first inverter (Inv1) and the second inverter (Inv2). Also, the memory switching element (MS) of the pixel memory 131*b* is turned on. Accordingly, the voltage between the first inverter (Inv1) and the second inverter (Inv2) are continuously alternated between low level and high level. In other words, the pixel voltage of high level is applied to the input terminal of the first inverter (Inv1) so as to output the pixel voltage of low level and apply the outputted pixel voltage to the second inverter (Inv2). The second inverter (Inv2) outputs the pixel voltage of high level by receiving the pixel voltage of low level and applies the outputted pixel voltage to the first inverter (Inv1).

Here, the common electrode (Vcom) is electrically coupled to the second clock line (CLK2) with the same voltage value as the common voltage ($V_{com}$) in the first delay period (D1), the first driving period (T1), the second delay period (D2) and the third driving period (T3) so as to apply the second clock voltage of low level. The pixel voltage of high level is applied to the pixel electrode ($V_{LC}$) and the second clock voltage of low level is applied to the common electrode ($V_{com}$). The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. The third driving period (T3) is a period for outputting the voltage from the pixel memory 131*b* to the pixel electrode ($V_{LC}$).

Referring to FIG. 4*b*, the timing chart of the pixel 131*a* and the pixel memory 131*b* includes the first driving period (T1), the second driving period (T2) and the third driving period (T3), and additionally may include the first delay period (D1) and the second delay period (D2). Comparing the timing chart of FIG. 4*b* to the timing chart of FIG. 4*a*, the voltage applied from the pixel electrode ($V_{LC}$) is changed from low level to high level and from high level to low level (i.e., reversed). Additionally, the voltage applied from the common electrode (Vcom) is changed from high level to low level and from low level to high level. The pixel 131*a* is turned off during the periods of D1, D2, T2 and T3 when the pixel memory 131*b* is inputted and outputted. Also, the order of the pixel voltages applied to the pixel memory 131*b* is changed in comparison to FIG. 4*a*, and the common voltage ($V_{com}$) applied to the liquid crystal (LC) cell of the pixel 131*a* is changed from the second clock voltage applied through the second clock line (CLK2) to the first clock voltage applied through the first clock line (CLK1). In other words, each operation of the pixel 131*a* and the pixel memory 131*b* are the same in FIGS. 4*a* and 4*b* except that the timing and the voltage level are changed.

Figure 5:
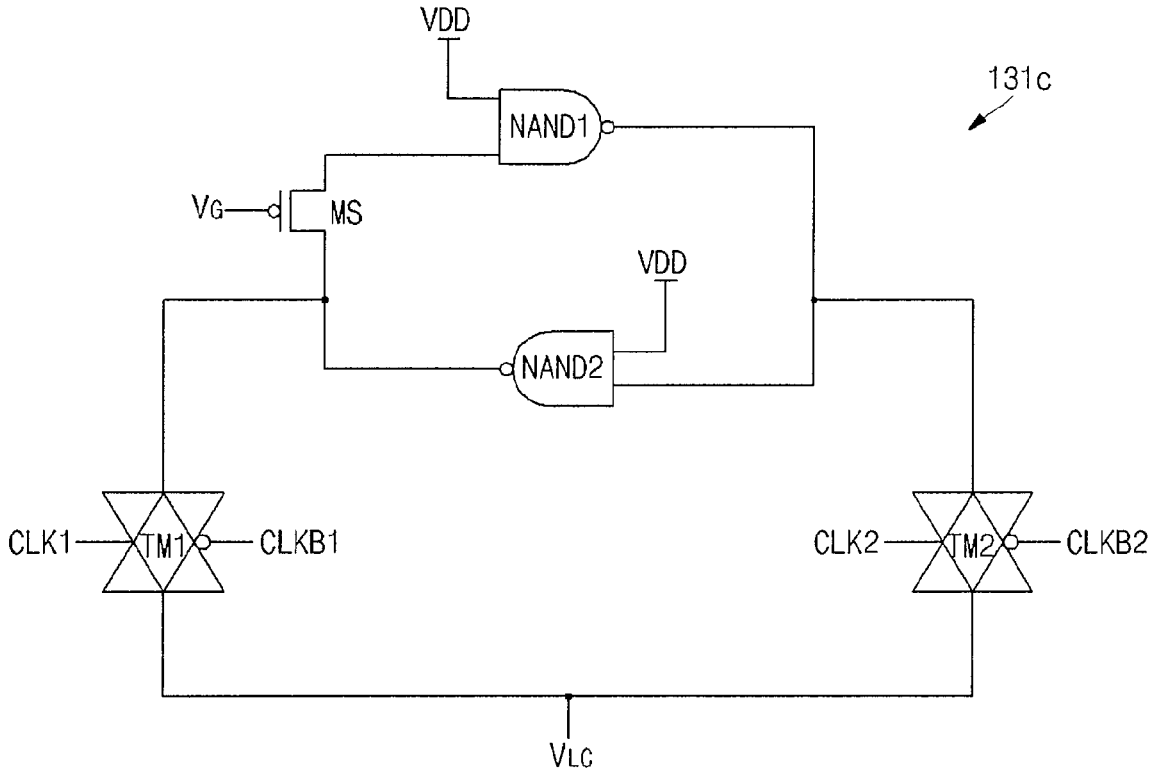
FIG. 5 is a circuit diagram illustrating a pixel memory of the liquid crystal display according to another exemplary embodiment of the present invention.

FIG. 5 is a circuit diagram illustrating a pixel memory 131*c* of a liquid crystal display according to another exemplary embodiment of the present invention.

Referring to FIG. 5, the pixel memory 131*c* of the LCD includes a first NAND gate (NAND1), a second NAND gate (NAND2), a memory switching element (MS), a first transmission gate (TM1) and a second transmission gate (TM2). A gate line electrically coupled to a control electrode (e.g., gate electrode) of the memory switching element (MS) is electrically coupled to the control electrode of the pixel switching element (PS) of FIG. 2. A pixel electrode ($V_{LC}$) between the first transmission gate (TM1) and the second transmission gate (TM2) is the same as the pixel electrode ($V_{LC}$) coupled to the liquid crystal (LC) cell and the capacitive element ($C_{st}$) of FIG. 2. In other words, the pixel 131*a* of FIG. 2 and the pixel memory 131*c* of FIG. 5 are electrically coupled to each other. In this exemplary embodiment, the memory switching element (MS) is shown as a P-channel metal oxide semiconductor (PMOS) transistor that is turned on when a low level voltage is applied to the control electrode (e.g., gate electrode), and the pixel switching element (PS) is shown as an N-channel metal oxide semiconductor NMOS transistor that is turned on when a high level voltage is applied to the control electrode (e.g., gate electrode), but the exemplary embodiment is not limited thereto. If the memory switching element (MS) is the NMOS, the pixel switching element (PS) becomes the PMOS, and if the memory switching element (MS) is the PMOS, the pixel switching element (PS) becomes the NMOS. Accordingly, when the gate voltage is applied to the control electrode through the gate line, the memory switching element (MS) and the pixel switching element (PS) are operated in opposite states. The pixel 131*a* and the pixel memory 131*c* display a still image for a long period of time.

The pixel 131*a* located in an OSD region is not operated, while the pixel memory 131*c* located in the OSD region is operated. The pixel memory 131*c* inputs/outputs the pixel voltage to the pixel electrode ($V_{LC}$)so as to operate the liquid crystal (LC) cell. When the pixel 131*a* of FIG. 2 is not operated, the drivers other than the gate driver (110) electrically coupled to the pixel (131*a*) are not operated, thereby allowing power consumption to be reduced.

The first NAND gate (NAND1) includes a first input terminal electrically coupled to a first power voltage line (VDD), a second input terminal electrically coupled to the first electrode of the memory switching element (MS), an output terminal electrically coupled to the second input terminal of the second NAND gate (NAND2) and the first electrode of the second transmission gate (TM2).

The first NAND gate (NAND1) outputs a voltage opposite to the voltage transferred from the memory switching element (MS) and transfers the outputted voltage to the second input terminal of the second NAND gate (NAND2) and the first electrode of the second transmission gate (TM2). In other words, in the first NAND gate (NAND1), if the voltage of high level is applied to the second input terminal, the voltage of low level is outputted to the output terminal, and if the voltage of low level is applied to the second input terminal, the voltage of high level is outputted to the output terminal to transfer the outputted voltage to the second input terminal of the second NAND gate (NAND2) and the first electrode of the second transmission gate (TM2).

The second NAND gate (NAND2) includes a first input terminal electrically coupled to the first power voltage line (VDD), the second input terminal electrically coupled to the output terminal of the first NAND gate (NAND1) and the first electrode of the second transmission gate (TM2), and the output terminal electrically coupled to the second electrode of the memory switching element (MS) and the first electrode of the first transmission gate (TM1).

The second NAND gate (NAND2) outputs a voltage opposite to the voltage outputted from the output terminal of the first NAND gate (NAND1) so as to transfer the outputted voltage to the second electrode of the memory switching element (MS) and the first electrode of the first transmission gate (TM1). In other words, the second NAND gate (NAND2) outputs the voltage of low level to the output terminal, if the voltage of high level is applied to the second input terminal, and outputs the voltage of high level to the output terminal, if the voltage of low level is applied to the second input terminal, so as to transfer each output voltage to the second electrode of the memory switching element (MS) and the first electrode of the first transmission gate (TM1). The second NAND gate (NAND2) outputs a voltage opposite to the pixel voltage transferred through the second transmission gate (TM2) to transfer the output voltage to the second electrode of the memory switching element (MS). In other words, the second NAND gate (NAND2) outputs the voltage of low level to the output terminal, if the pixel voltage of high level is applied to the second input terminal, and outputs the voltage of high level to the output terminal, if the voltage of low level is applied to the second input terminal. Each output voltage is transferred to the second electrode of the memory switching element (MS).

When the memory switching element (MS) between the first NAND gate (NAND1) and the second NAND gate (NAND2) is turned on, the voltage between the first NAND gate (NAND1) and the second NAND gate (NAND2) is changed from high level to low level and from low level to high level whenever it passes through the NAND gate. For example, if the voltage of high level is applied to the second input terminal of the first NAND gate (NAND1), the voltage of low level is outputted. and applied to the second input terminal of the second NAND gate (NAND2). In addition, the second NAND gate (NAND2) outputs the voltage of high level to the output terminal so as to apply the outputted voltage to the first NAND gate (NAND1). As a result, each of the outputted voltages is alternated.

The memory switching element (MS) includes the control electrode (e.g., gate electrode) electrically coupled to the gate line, the first electrode electrically coupled to the second input terminal of the first NAND gate (NAND1), and the second electrode electrically coupled to the output terminal of the second NAND gate (NAND2) and the first electrode of the first transmission gate (TM1).

The gate line is the same as that applied to the pixel 131*a* of the LCD. The same voltage as the gate voltage applied to the control electrode of the pixel switching element (PS) of the pixel 131*a* is applied to the control electrode of the memory switching element (MS). The memory switching element (MS) is turned on by applying the gate voltage of low level to the control electrode so as to transfer the voltage outputted from the output terminal of the second NAND gate (NAND2) to the second input terminal of the first NAND gate (NAND1). Also, the memory switching element (MS) transfers the pixel voltage transferred through the first transmission gate (TM1) to the second input terminal of the first NAND gate (NAND1). In other words, the memory switching element (MS) transfers the pixel voltage transferred from the first transmission gate (TM1) to the second input terminal of the first NAND gate (NAND1) when the first transmission gate (TM1) is turned on, and connects/disconnects the connection between the second input terminal of the first NAND gate (NAND1) and the output terminal of the second NAND gate (NAND2) when the first transmission gate (TM1) is turned off.

With respect to the first transmission gate (TM1), the first electrode is electrically coupled to the second electrode of the memory switching element (MS) and the output terminal of the second NAND gate (NAND2), the second electrode is electrically coupled to the pixel electrode ($V_{LC}$), the first clock terminal is electrically coupled to the first clock line (CLK1), and the second clock terminal is electrically coupled to the first negative clock line (CLKB1).

The pixel electrode ($V_{LC}$) of FIG. 5 is electrically coupled to the pixel electrode ($V_{LC}$) of the pixel 131*a* of FIG. 2 in the LCD to apply the pixel voltage to the pixel electrode ($V_{LC}$) of the liquid crystal (LC) cell of FIG. 2. The first transmission gate (TM1) is turned on by applying the first clock voltage of high level and the first negative clock voltage of low level so as to transfer the pixel voltage applied from pixel electrode ($V_{LC}$) to the memory switching element (MS) and the voltage outputted from the output terminal of the second NAND gate (NAND2) to the pixel electrode ($V_{LC}$). In other words, the pixel voltage is inputted to and outputted from the pixel electrode ($V_{LC}$).

When the first clock voltage applied from the first clock line (CLK1) is high level, the first negative clock voltage applied from the first negative clock line (CLKB1) becomes low level, and when the first clock voltage is low level, the first negative clock voltage becomes high level. When the first clock voltage is high level and the first negative clock voltage is low level, the transmission gate is turned on (i.e., enable voltage).

The first transmission gate (TM1) can prevent or reduce voltage drop in comparison to using a single transistor. When only an N-type transistor is used, the N-type transistor is turned on by applying the voltage of high level to the gate electrode so as to output the voltage applied to the first electrode to the second electrode. Here, if the voltage value applied to the first electrode is high level, the voltage drop is produced by the threshold voltage of the N-type transistor. When only a P-type transistor is used, the P-type transistor is turned on by applying the voltage of low level to the gate electrode so as to output the voltage applied to the first electrode to the second electrode. Here, if the voltage applied to the first electrode is low level, the voltage drop is produced by the threshold voltage of the P-type transistor.

The first transmission gate (TM1) includes a N-type transistor and a P-type transistor. The first and second electrodes of the P-type transistor are coupled to the first and second electrodes of the N-type transistor, respectively. When a high level voltage is applied to the control electrode of the N-type transistor and a low level voltage is applied to the control electrode of the P-type transistor, the first transmission gate (TM1) is turned on. When the first transmission gate (TM1) is turned on, the input voltage of high level is transferred to the second electrode through the P-type transistor, and the input voltage of low level is transferred to the second electrode through the N-type transistor, thereby allowing the voltage drop to be prevented or reduced.

With respect to the second transmission gate (TM2), the first electrode is electrically coupled between the output terminal of the first NAND gate (NAND1) and the second input terminal of the second NAND gate (NAND2), the second electrode is electrically coupled to the pixel electrode ($V_{LC}$), the first clock terminal is electrically coupled to the second clock line (CLK2), and the second clock terminal is electrically coupled to the second clock line (CLKB2).

The pixel electrode ($V_{LC}$) is electrically coupled to the pixel electrode ($V_{LC}$) of the pixel 131*a* of FIG. 2 in the LCD to apply the pixel voltage to the pixel electrode ($V_{LC}$) of the liquid crystal (LC) cell of FIG. 2. The second transmission gate (TM2) is turned on by applying the second clock voltage of high level and the second negative clock voltage of low level so as to transfer the pixel voltage applied from pixel electrode ($V_{LC}$) to the second input terminal of the second NAND gate (NAND2) and the pixel voltage outputted from the output terminal of the first NAND gate (NAND1) to the pixel electrode ($V_{LC}$). In other words, the pixel voltage is inputted to and outputted from the pixel electrode ($V_{LC}$) through the second transmission gate (TM2).

When the second clock voltage applied from the second clock line (CLK2) is high level, the second negative clock voltage applied form the second negative clock line (CLKB2) becomes low level, and when the second clock voltage is low level, the second negative clock voltage becomes high level. When the second clock voltage is high level and the second negative clock voltage is low level, the transmission gate is turned on (i.e., enable voltage).

The second transmission gate (TM2) can prevent or reduce voltage drop produced in comparison to using single transistor instead of the second transmission gate (TM2). The N-type transistor is turned on by applying the voltage of high level to the gate electrode so as to output the voltage applied to the first electrode to the second electrode. Here, if the voltage value applied to the first electrode is high level, the voltage drop is produced by the threshold voltage of the N-type transistor. The P-type transistor is turned on by applying the voltage of low level to the gate electrode so as to output the voltage applied to the first electrode to the second electrode. Here, if the voltage applied to the first electrode is low level, the voltage drop is produced by the threshold voltage of the P-type transistor.

The second transmission gate (TM2) includes both a N-type transistor and a P-type transistor. The first and second electrodes of the P-type transistor are electrically coupled to the first and second electrodes of the N-type transistor, respectively. When high level voltage is applied to the control electrode of the N-type transistor and low level voltage is applied to the control electrode of the P-type transistor, the second transmission gate (TM2) is turned on. When the second transmission gate (TM2) is turned on, the input voltage of high level is transferred to the second electrode through the P-type transistor, and the input voltage of low level is transferred to the second electrode through the N-type transistor, thereby allowing the voltage drop to be prevented or reduced.

Figure 6A:
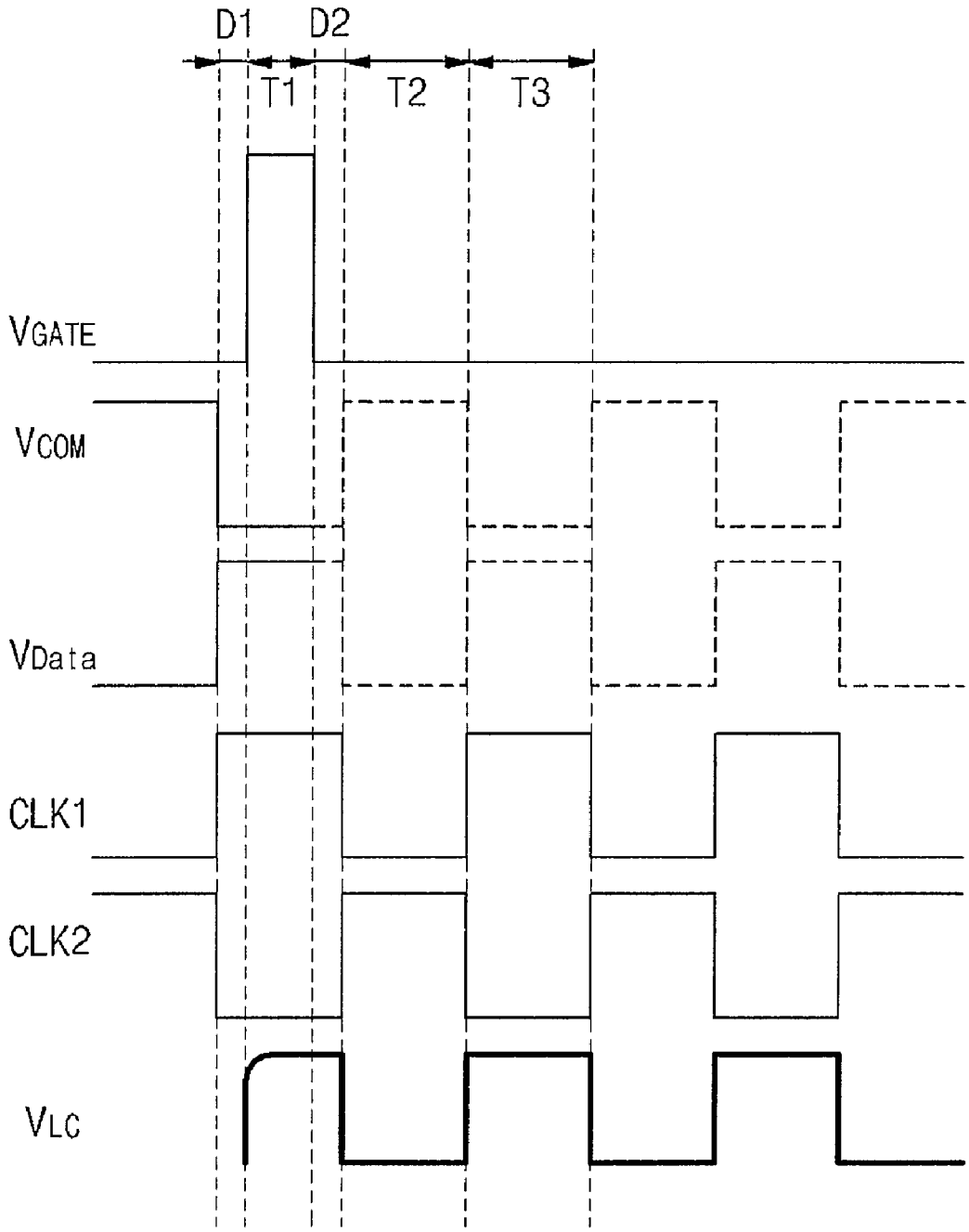
FIGS. 6*a* and 6*b* are timing diagrams of the pixel and the pixel memory of the liquid crystal display shown in FIGS. 2 and 5, respectively.
Figure 6B:
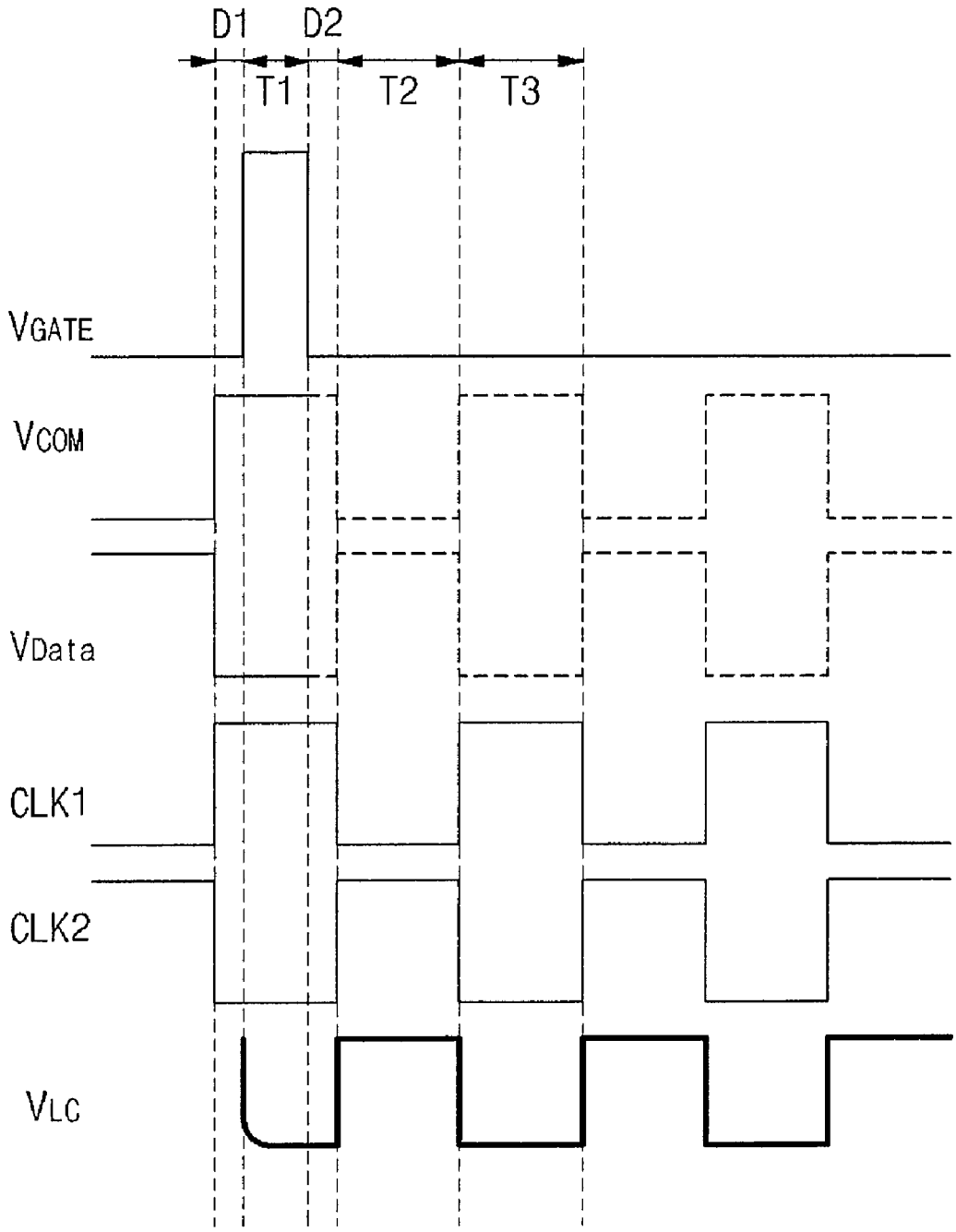

FIGS. 6*a* and 6*b* are respectively timing diagrams of the pixel 131*a* and the pixel memory 131*c* of the liquid crystal display shown in FIGS. 2 and 5.

Referring to FIG. 6*a*, the timing chart of the pixel 131*a* and the pixel memory 131*c* includes a first driving period (T1), a second driving period (T2) and a third driving period (T3), and may additionally include a first delay period (D1) and a second delay period (D2).

First, in the first delay period (D1), the gate voltage ($V_{GATE}$) of low level is applied to the pixel 131*a* and the pixel memory 131*c*, the common voltage ($V_{com}$) of low level and the data voltage ($V_{DATA}$) of high level are applied to the pixel 131*a*, and the first clock voltage of high level and the second clock voltage of low level are applied to the pixel memory 131*c*.

In the first delay period (D1), the pixel 131*a* is turned off by applying the gate voltage ($V_{GATE}$) of low level to the control electrode of the pixel switching element (PS), and the pixel memory (131*c*) is turned on by applying the gate voltage ($V_{GATE}$) of low level to the control electrode of the memory switching element (MS). The first transmission gate (TM1) of the pixel memory 131*c* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second clock terminal.

In the first delay period (D1), the common voltage ($V_{com}$) and the data voltage ($V_{DATA}$) are constantly maintained prior to the first driving period (T1). The first delay period (D1) is a period that the gate voltage ($V_{GATE}$) is changed from low level to high level. This can assure clock skew margin or delay margin.

In the first driving period (T1), the gate voltage ($V_{GATE}$) of high level is applied to the pixel 131*a* and the pixel memory 131*c*, the common voltage ($V_{com}$) of low level and the data voltage ($V_{DATA}$) of high level are applied to the pixel 131*a*, and the first clock voltage of high level and the second clock voltage of low level are applied to the pixel memory 131*c*.

The pixel switching element (PS) of the pixel 131*a* is turned on by applying the gate voltage ($V_{GATE}$) of high level. The pixel switching element (PS) is turned on so as to transfer the data voltage ($V_{DATA}$) of high level applied from the first electrode to the pixel electrode ($V_{LC}$). Here, across the liquid crystal (LC) cell and the capacitive element ($C_{st}$), the data voltage ($V_{DATA}$) of high level is applied via the pixel electrode ($V_{LC}$), and the common voltage ($V_{com}$) of low level is applied via the common electrode (Vcom). As the result thereof, the liquid crystal (LC) cell controls a light transmission rate by changing an array state of liquid crystal cells according to horizontal electric field formed by a voltage difference between both electrodes in order to realize a gray level, and the capacitive element ($C_{st}$) stores the voltage difference between the pixel electrode ($V_{LC}$) and the common electrode (Vcom).

The first transmission gate (TM1) of the pixel memory 131*c* is turned on by applying the first clock voltage of high level to the first clock terminal and applying the first negative clock voltage of low level to the second clock terminal, so that the data voltage ($V_{DATA}$) of high level applied to the pixel electrode ($V_{LC}$) is applied to the second electrode of the memory switching element (MS). The memory switching element (MS) is turned off by applying the gate voltage ($V_{GATE}$) of high level.

In the second delay period (D2), the gate voltage ($V_{GATE}$) of low level is applied to the pixel 131*a* and the pixel memory 131*c*, and the first clock voltage of high level and the second clock voltage of low level are applied to the pixel memory 131*c*.

The pixel 131*a* is turned off by applying the gate voltage ($V_{GATE}$) of low level to the control electrode of the pixel switching element (PS). The pixel memory 131*c* is turned on by applying the gate voltage ($V_{GATE}$) of low level to the control electrode of the memory switching element (MS). The first transmission gate (TM1) of the pixel memory 131*c* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second clock terminal.

The memory switching element (MS) and the first transmission gate (TM1) of the pixel memory 131*c* are turned on so that the data voltage ($V_{DATA}$) of high level applied to the pixel electrode ($V_{LC}$) is applied to a second input terminal of a first NAND gate (NAND1) to output the voltage of low level. A second NAND gate (NAND2) receives the voltage of low level to output the voltage of high level and applies the outputted voltage to the first NAND gate (NAND1). In other words, the voltage between the first NAND gate (NAND1) and the second NAND gate (NAND2) is changed between low level and high level alternately. The pixel voltage of high level outputted to the output terminal of the second NAND gate (NAND2) is outputted to the pixel electrode ($V_{LC}$).

Here, the second clock voltage is applied to the common electrode by electrically coupling to the second clock line (CLK2) with the same voltage value of low level as the common voltage ($V_{com}$) in the first delay period (D1). The pixel voltage of high level is applied to the pixel electrode ($V_{LC}$), and the second clock voltage of low level is applied to the common electrode (Vcom). The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. When the pixel 131*a* is turned off, the common voltage and the data voltage are not applied to the pixel 131*a*, and the liquid crystal (LC) cell is operated by the pixel memory 131*b*. The liquid crystal (LC) cell of the pixel 131*a* can be operated without applying the common voltage and the data voltage, thereby allowing the power consumption of the module operating the driver to be reduced. Accordingly, total power consumption of the LCD can be reduced. After the second delay period (D2), the pixel 131*a* is not operated (i.e., the pixel switching element is turned off), and the liquid crystal (LC) cell is operated by outputting a voltage to be applied to the pixel electrode ($V_{LC}$) from the pixel memory 131*c*. The second delay period (D2) is a period of inputting/outputting the voltage from/to the pixel electrode ($V_{LC}$) to/from the pixel memory 131*c*.

In the second driving period (T2), the gate voltage ($V_{GATE}$) of low level through the gate line is applied to the pixel 131*a* and the pixel memory (131*c*), and the first clock voltage of low level through the first clock line (CLK1) and the second clock voltage of high level through the second clock line (CLK2) are applied to the pixel memory 131*c*. Here, the pixel switching element (PS) of the pixel 131*a* is turned off by applying the gate voltage ($V_{GATE}$) of low level to the control electrode, and thus the pixel 131*a* is not operated.

The memory switching element (MS) of the pixel memory 131*c* is turned on by applying the gate voltage ($V_{GATE}$) of low level to the control electrode. The first transmission gate (TM1) of the pixel memory 131*c* is turned off by applying the first clock voltage of low level to the first clock terminal and applying the first negative clock voltage of high level to the second clock terminal. The second transmission gate (TM2) is turned on by applying the second clock voltage of high level to the first clock terminal and applying the second negative clock voltage of low level to the second clock terminal. The second transmission gate (TM2) of the pixel memory 131*c* is turned on to output the pixel voltage of low level outputted to the output terminal of the first NAND gate (NAND1) to the pixel electrode ($V_{LC}$) through the second transmission gate (TM2) while the pixel voltage changes between low level and high level between the first NAND gate (NAND1) and the second NAND gate (NAND2). The memory switching element (MS) of the pixel memory 131*c* is turned on. Accordingly, the voltage between the first NAND gate (NAND1) and the second NAND gate (NAND2) are continuously alternated between low level and high level. In other words, the pixel voltage of low level is applied to the second input terminal of the second NAND gate (NAND2) so as to output the pixel voltage of high level and apply the outputted pixel voltage to the first NAND gate (NAND1). The first NAND gate (NAND1) outputs the pixel voltage of low level by receiving the pixel voltage of high level and applies the outputted pixel voltage to the second NAND gate (NAND).

Here, the common electrode (Vcom) is electrically coupled to the second clock line (CLK2) with the same voltage value as the common voltage ($V_{com}$) in the first delay period (D1), the first driving period (T1) and the second delay period (D2) so as to apply the second clock voltage. The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. The second driving period (T2) is a period for outputting the voltage from the pixel memory 131*b* to the pixel electrode.

Finally, in the third driving period (T3), the gate voltage ($V_{GATE}$) of low level through the gate line is applied to the pixel 131*a* and the pixel memory 131*b*, and the first clock voltage of high level through the first clock line (CLK1) and the second clock voltage of low level through the second clock line (CLK2) are applied to the pixel memory 131*c*. Here, the pixel switching element (PS) of the pixel 131*a* is turned off by applying the gate voltage ($V_{GATE}$) of low level to the control electrode, and thus the pixel 131*a* is not operated.

The memory switching element (MS) of the pixel memory 131*c* is turned on by applying the gate voltage ($V_{GATE}$) of low level to the control electrode. The first transmission gate (TM1) of the pixel memory 131*c* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second clock terminal. The first transmission gate (TM1) of the pixel memory 131*c* is turned on to output the pixel voltage of high level outputted to the output terminal of the second NAND gate (NAND2) to the pixel electrode ($V_{LC}$) through the first transmission gate (TM1) while the voltage level between the first NAND gate (NAND1) and the second NAND gate (NAND2) are changed between low level and high level. The memory switching element (MS) of the pixel memory 131*c* is turned on. Accordingly, the voltage level between the first NAND gate (NAND1) and the second NAND gate (NAND2) are continuously alternated between low level and high level. In other words, the pixel voltage of high level is applied to the second input terminal of the first NAND gate (NAND1) so as to output the pixel voltage of low level and apply the outputted pixel voltage to the second NAND gate (NAND2). The second NAND gate (NAND2) outputs the pixel voltage of high level by receiving the pixel voltage of low level and applies the outputted pixel voltage to the first NAND gate (NAND1).

Here, the common electrode (Vcom) is electrically coupled to the second clock line (CLK2) with the same voltage value as the common voltage ($V_{com}$) in the first delay period (D1), the first driving period (T1), the second delay period (D2) and the third driving period (T3) so as to apply the second clock voltage of low level. The pixel voltage of high level is applied to the pixel electrode ($V_{LC}$), and the second clock voltage of low level is applied to the common electrode ($V_{com}$). The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. The third driving period (T3) is a period for outputting the voltage from the pixel memory (131*c*) to the pixel electrode.

Referring to FIG. 6*b*, the timing chart of the pixel 131*a* and the pixel memory 131*b* includes the first driving period (T1), the second driving period (T2) and the third driving period (T3), and additionally may include the first delay period (D1) and the second delay period (D2). Comparing the timing chart of FIG. 6*b* to the timing chart of FIG. 6*a*, the voltage applied from the pixel electrode ($V_{LC}$) is changed from low level to high level and from high level to low level (i.e., reversed). Additionally, the voltage applied from the common electrode (Vcom) is changed from high level to low level and from low level to high level (i.e., reversed). The pixel 131*a* is turned off (i.e., the pixel switching element is turned off), and thus when the pixel memory 131*c* is inputted and outputted, the pixel voltages applied to the pixel memory 131*c* are sequentially changed, and the common voltage ($V_{COM}$) applied to the liquid crystal (LC) cell of the pixel 131*a* is changed from the second clock voltage applied through the second clock line (CLK2) to the first clock voltage applied through the first clock line (CLK1). In other words, each operation of the pixel 131*a* and the pixel memory 131*c* is the same in FIGS. 6*a* and 6*b* except that the timing and the voltage level are changed.

Figure 7:
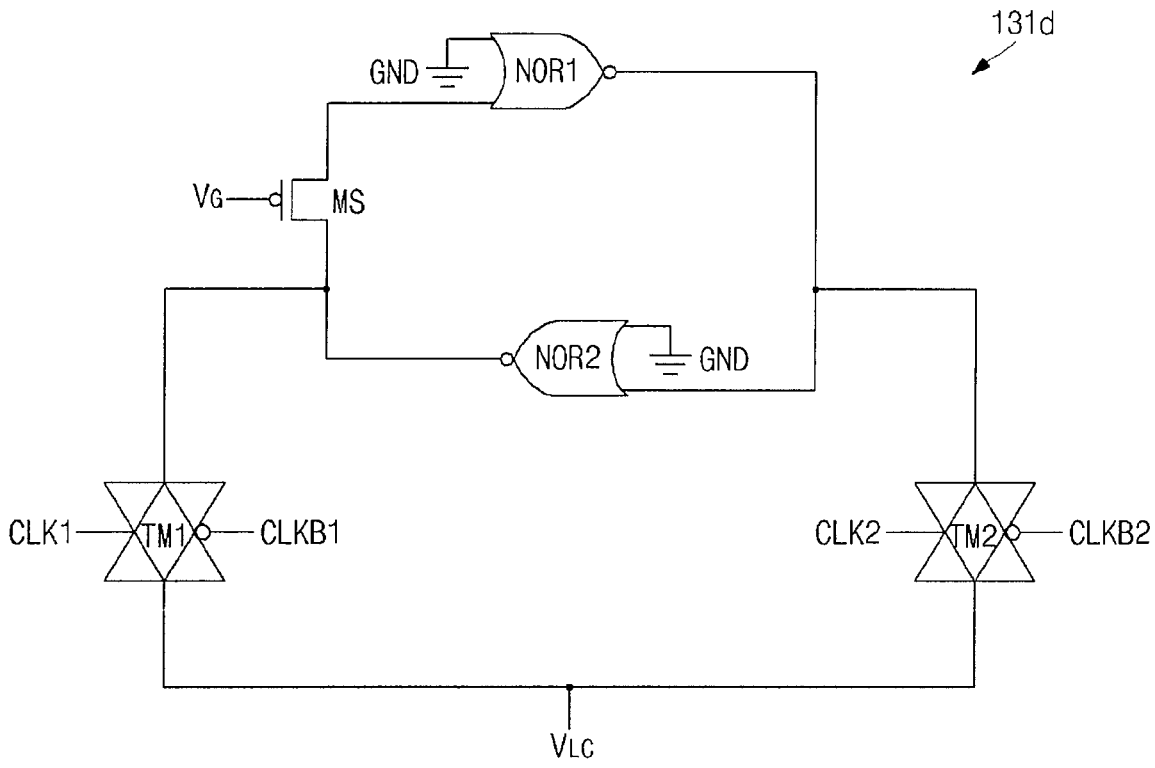
FIG. 7 is a circuit diagram illustrating a pixel memory of the liquid crystal display according to another exemplary embodiment of the present invention.

FIG. 7 is a circuit diagram illustrating a pixel memory 131*d* of the liquid crystal display according to another exemplary embodiment of the present invention.

Referring to FIG. 7, the pixel memory 131*d* of the LCD includes a first NOR gate (NOR1), a second NOR gate (NOR2), a memory switching element (MS), a first transmission gate (TM1) and a second transmission gate (TM2).

A gate line electrically coupled to a control electrode of the memory switching element (MS) is electrically coupled to the control electrode of the pixel switching element (PS) of FIG. 2. A pixel electrode ($V_{LC}$) between the first transmission gate (TM1) and the second transmission gate (TM2) is the same as the pixel electrode ($V_{LC}$) coupled to the liquid crystal (LC) cell and the capacitive element ($C_{st}$) of FIG. 2. In other words, the pixel 131*a* of FIG. 2 and the pixel memory 131*d* of FIG. 7 are electrically coupled to each other.

In this exemplary embodiment, the memory switching element (MS) is shown as a P-channel metal oxide semiconductor (PMOS) transistor that is turned on when the voltage of low level is applied to the control electrode, and the pixel switching element (PS) is shown as an N-channel metal oxide semiconductor (NMOS) transistor that is turned on when the voltage of high level is applied to the control electrode, but the embodiment is not limited thereto. If the memory switching element (MS) is the NMOS, the pixel switching element (PS) becomes the PMOS, and if the memory switching element (MS) is the PMOS, the pixel switching element (PS) becomes the NMOS. Accordingly, when the gate voltage is applied to the control electrode through the gate line, the memory switching element (MS) and the pixel switching element (PS) are operated in opposite states.

The pixel 131*a* and the pixel memory 131*d* display a still image for a long period of time. The pixel 131*a* is not operated when it is located in an OSD region, while the pixel memory 131*d* is operated when it is located in the OSD region. The pixel memory 131*d* inputs/outputs the pixel voltage to the pixel electrode so as to operate the liquid crystal (LC) cell. Here, as the pixel 131*a* of FIG. 2 is not operated, the drivers other than a gate driver 110 electrically coupled to the pixel 131*a* are not operated, thereby allowing power consumption to be reduced.

The first NOR gate (NOR1) includes a first input terminal electrically coupled to a ground (GND), a second input terminal electrically coupled to the first electrode of the memory switching element (MS), an output terminal electrically coupled to the second input terminal of the second NOR gate (NOR2) and the first electrode of the second transmission gate (TM2).

The first NOR gate (NOR1) outputs a voltage opposite to the voltage transferred from the memory switching element (MS) to transfer the outputted voltage to the second input terminal of the second NOR gate (NOR2) and the first electrode of the second transmission gate (TM2). In other words, in the first NOR gate (NOR1), if the voltage of high level is applied to the second input terminal, the voltage of low level is outputted to the output terminal, and if the voltage of low level is applied to the second input terminal, the voltage of high level is outputted to the output terminal to transfer the outputted voltage to the second input terminal of the second NOR gate (NOR2) and the first electrode of the second transmission gate (TM2).

The second NOR gate (NOR2) includes the first input terminal electrically coupled to the ground (GND), the second input terminal electrically coupled between the output terminal of the first NOR gate (NOR1) and the first electrode of the second transmission gate (TM2), and the output terminal electrically coupled to the second electrode of the memory switching element (MS) and the first electrode of the first transmission gate (TM1).

The second NOR gate (NOR2) outputs a voltage opposite to the voltage outputted from the output terminal of the first NOR gate (NOR1) so as to transfer the outputted voltage to the second electrode of the memory switching element (MS) and the first electrode of the first transmission gate (TM1). In other words, the second NOR gate (NOR2) outputs the voltage of the low level to the output terminal, if the voltage of high level is applied to the second input terminal, and outputs the voltage of high level to the output terminal, if the voltage of low level is applied to the second input terminal, so as to transfer each output voltage to the second electrode of the memory switching element (MS) and the first electrode of the first transmission gate (TM1). The second NOR gate (NOR2) outputs a voltage opposite to the pixel voltage transferred through the second transmission gate (TM2) to transfer the output voltage to the second electrode of the memory switching element (MS). In other words, the second NOR gate (NOR2) outputs the voltage of low level to the output terminal if the pixel voltage of high level is applied to the second input terminal, and outputs the voltage of high level to the output terminal if the voltage of low level is applied to the second input terminal. Each output voltage is transferred to the second electrode of the memory switching element (MS).

When the memory switching element (MS) between the first NOR gate (NOR1) and the second NOR gate (NOR2) is turned on, the voltage between the first NOR gate (NOR1) and the second NOR gate (NOR2) is changed from high level to low level and from low level to high level whenever it passes through one of the NOR gates. For example, if the voltage of high level is applied to the second input terminal of the first NOR gate (NOR1), the voltage of low level is outputted. The outputted voltage is applied to the second input terminal of the second NOR gate (NOR2). In addition, the second NOR gate (NOR2) outputs the voltage of high level to the output terminal so as to apply the outputted voltage to the first NOR gate (NOR1). As a result, each of the outputted voltages is alternated.

The memory switching element (MS) includes the control electrode electrically coupled to the gate line, the first electrode electrically coupled to the second input terminal of the first NOR gate (NOR1), and the second electrode electrically coupled to the output terminal of the second NOR gate (NOR2) and the first electrode of the first transmission gate (TM1).

The gate line is the same as that applied to the pixel 131*a* of the LCD, and the same voltage as the gate voltage applied to the control electrode of the pixel switching element (PS) of the pixel 131*a* is applied to the control electrode of the memory switching element (MS). The memory switching element (MS) is turned on by applying the gate voltage of low level to the control electrode so as to transfer the voltage outputted from the output terminal of the second NOR gate (NOR2) to the second input terminal of the first NOR gate (NOR1). The memory switching element (MS) transfers the pixel voltage transferred through the first transmission gate (TM1) to the second input terminal of the first NOR gate (NOR1). In other words, the memory switching element (MS) transfers the pixel voltage transferred from the first transmission gate (TM1) to the second input terminal of the first NOR gate (NOR1) when the first transmission gate (TM1) is turned on, and connects/disconnects the connection between second input terminal of the first NOR gate (NOR1) and output terminal of the second NOR gate (NOR2) when the first transmission gate (TM1) is turned off.

In the first transmission gate (TM1), the first electrode is electrically coupled to the second electrode of the memory switching element (MS) and the output terminal of the second NOR gate (NOR2), the second electrode is electrically coupled to the pixel electrode ($V_{LC}$), the first clock terminal is electrically coupled to the first clock line (CLK1), and the second clock terminal is electrically coupled to the first negative clock line (CLKB1).

The pixel electrode ($V_{LC}$) is electrically coupled to the pixel electrode ($V_{LC}$) of the pixel 131*a* in the LCD to apply the pixel voltage to the pixel electrode ($V_{LC}$) of the liquid crystal (LC) cell. The first transmission gate (TM1) is turned on by applying the first clock voltage of high level and the first negative clock voltage of low level so as to transfer the pixel voltage applied from pixel electrode ($V_{LC}$) to the memory switching element (MS) and the voltage outputted from the output terminal of the second NOR gate (NOR2) to the pixel electrode ($V_{LC}$). In other words, the pixel voltage is inputted to and outputted from the pixel electrode ($V_{LC}$).

When the first clock voltage applied from the first clock line (CLK1) is high level, the first negative clock voltage applied form the first negative clock line (CLKB1) becomes low level, and when the first clock voltage is low level, the first negative clock voltage becomes high level. When the first clock voltage is high level and the first negative clock voltage is low level, the transmission gate (e.g., TM1) is turned on (i.e., enable voltage).

The first transmission gate (TM1) can prevent or reduce voltage drop in comparison to using only a single transistor.

When only an N-type transistor is used, the N-type transistor is turned on by applying the voltage of high level to the gate electrode so as to output the voltage applied to the first electrode to the second electrode. Here, if the voltage value applied to the first electrode is high level, the voltage drop is produced by the threshold voltage of the N-type transistor. When only a P-type transistor is used, the P-type transistor is turned on by applying the voltage of low level to the gate electrode, so as to output the voltage applied to the first electrode to the second electrode. Here, if the voltage applied to the first electrode is low level, the voltage drop is produced by the threshold voltage of the P-type transistor.

The first transmission gate (TM1) includes an N-type transistor and a P-type transistor. The first and second electrodes of the P-type transistor are electrically coupled to the first and second electrodes of the N-type transistor, respectively. When high level voltage is applied to the control electrode of the N-type transistor and low level voltage is applied to the control electrode of the P-type transistor, the first transmission gate (TM1) is turned on. When the first transmission gate (TM1) is turned on, the input voltage of high level is transferred to the second electrode through the P-type transistor, and the input voltage of low level is transferred to the second electrode through the N-type transistor, thereby allowing the voltage drop to be prevented or reduced.

In the second transmission gate (TM2), the first electrode is electrically coupled to the output terminal of the first NOR gate (NOR1) and the second input terminal of the second NOR gate (NOR2), the second electrode is electrically coupled to the pixel electrode ($V_{LC}$), the first clock terminal is electrically coupled to the second clock line (CLK2), and the second clock terminal is electrically coupled to the second clock line (CLKB2).

The pixel electrode ($V_{LC}$) is electrically coupled to the pixel electrode ($V_{LC}$) of the pixel 131*a* of FIG. 2 in the LCD to apply the pixel voltage to the pixel electrode ($V_{LC}$) of the liquid crystal (LC) cell. The second transmission gate (TM2) is turned on by applying the second clock voltage of high level and the second negative clock voltage of low level so as to transfer the pixel voltage applied from pixel electrode ($V_{LC}$) to the second input terminal of the second NOR gate (NOR2) and the pixel voltage outputted from the output terminal of the first NOR gate (NOR1) to the pixel electrode ($V_{LC}$). In other words, the pixel voltage is inputted to and outputted from the pixel electrode ($V_{LC}$).

When the second clock voltage applied from the second clock line (CLK2) is high level, the second negative clock voltage applied from the second negative clock line (CLKB1) becomes low level, and when the second clock voltage is low level, the second negative clock voltage becomes high level. When the second clock voltage is high level and the second negative clock voltage is low level, the second transmission gate TM2 is turned on (i.e., enable voltage).

The second transmission gate (TM2) can prevent or reduce voltage drop produced by using a single transistor in place of the second transmission gate (TM2). The N-type transistor is turned on by applying the voltage of high level to the gate electrode so as to output the voltage applied to the first electrode to the second electrode. Here, if the voltage value applied to the first electrode is high level, the voltage drop is produced by the threshold voltage of the N-type transistor. The P-type transistor is turned on by applying the voltage of low level to the gate electrode so as to output the voltage applied to the first electrode to the second electrode. Here, if the voltage applied to the first electrode is low level, the voltage drop is produced by the threshold voltage of the P-type transistor.

The second transmission gate (TM2) includes an N-type transistor and a P-type transistor. The first and second electrodes of the P-type transistor are electrically coupled to the first and second electrodes of the N-type transistor, respectively. When high level voltage is applied to the control electrode of the N-type transistor and low level is applied to the control electrode of the P-type transistor, the second transmission gate (TM2) is turned on. When the second transmission gate (TM2) is turned on, the input voltage of high level is transferred to the second electrode through the P-type transistor, and the input voltage of low level is transferred to the second electrode through the N-type transistor, thereby allowing the voltage drop to be prevented or reduced.

Figure 8A:
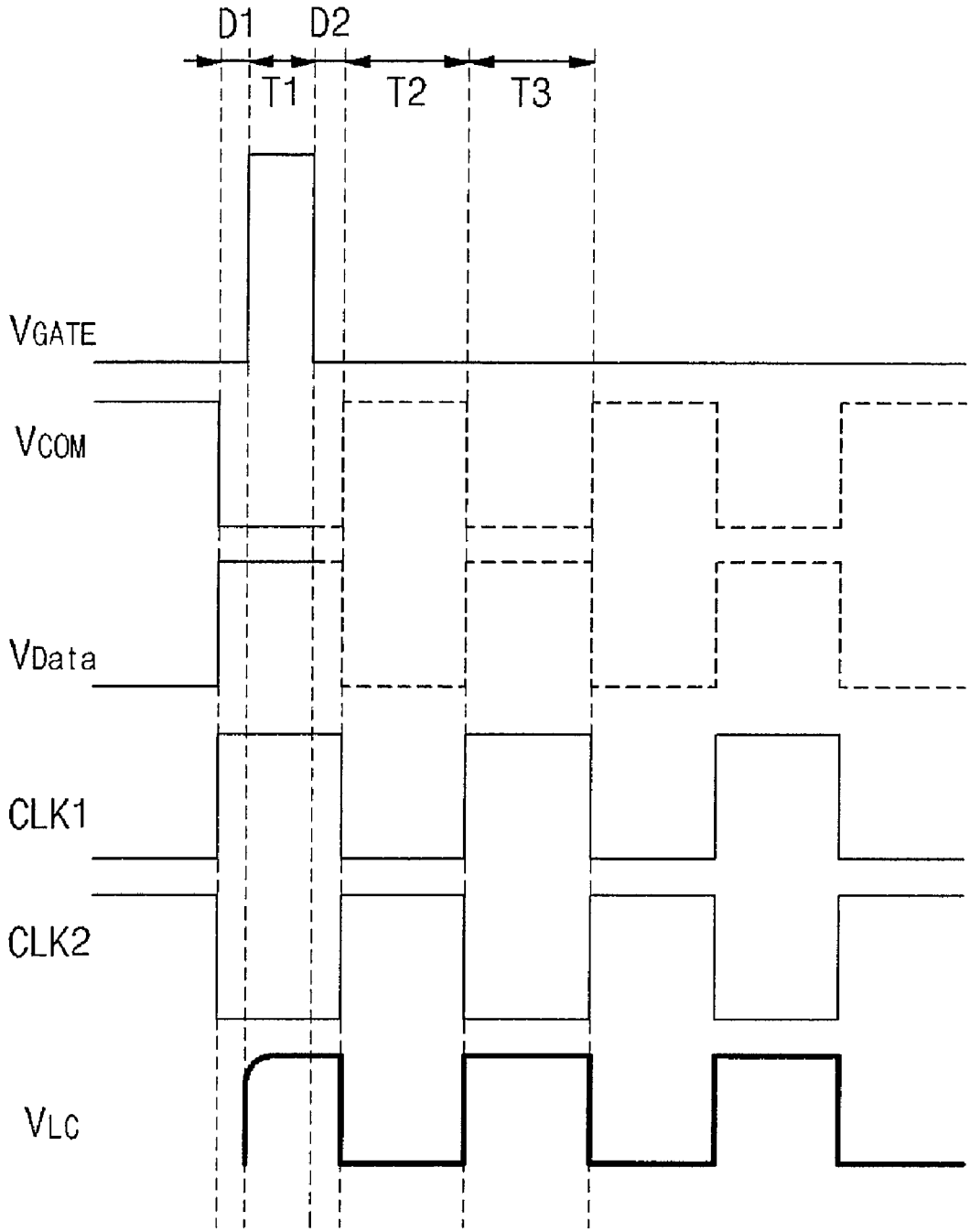
FIGS. 8*a* and 8*b* are timing diagrams of the pixel and the pixel memory of the liquid crystal display shown in FIGS. 2 and 7, respectively.
Figure 8B:
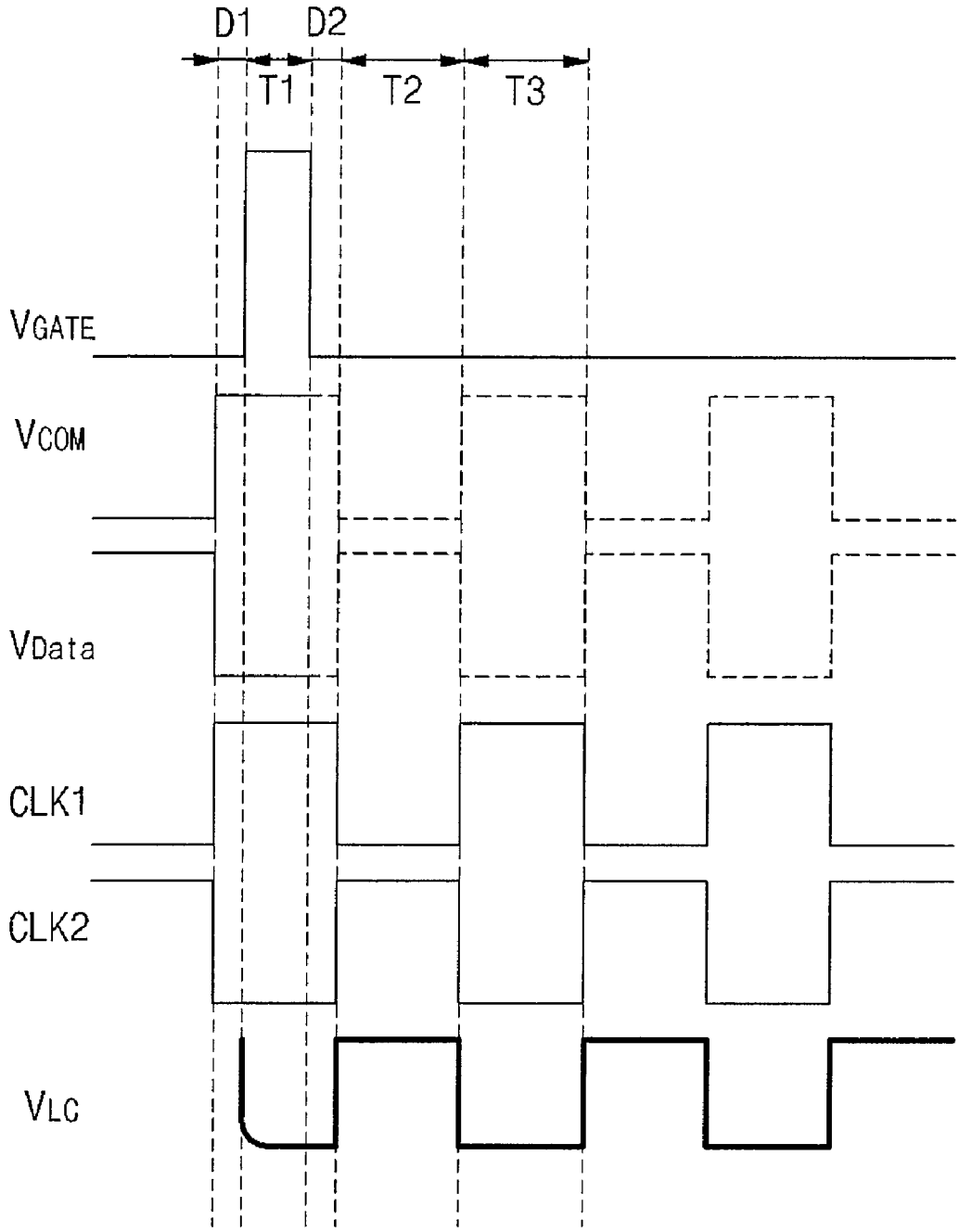

FIGS. 8*a* and 8*b* are respectively timing diagrams of the pixel 131*a* and the pixel memory 131*d* of the liquid crystal display shown in FIGS. 2 and 7

Referring to FIG. 8*a*, the timing chart of the pixel 131*a* and the pixel memory 131*d* includes a first driving period (T1), a second driving period (T2) and a third driving period (T3), and may additionally include a first delay period (D1) and a second delay period (D2).

First, in the first delay period (D1), the gate voltage ($V_{GATE}$) of low level is applied to the pixel 131*a* and the pixel memory 131*d*, the common voltage ($V_{com}$) of low level and the data voltage ($V_{DATA}$) of high level are applied to the pixel 131*a*, and the first clock voltage of high level and the second clock voltage of low level are applied to the pixel memory 131*d*.

In the first delay period (D1), the pixel 131*a* is turned off by applying the gate voltage ($V_{GATE}$) of low level to the control electrode of the pixel switching element (PS), and the pixel memory 131*d* is turned on by applying the gate voltage ($V_{GATE}$) of low level to the control electrode of the memory switching element (MS). The first transmission gate (TM1) of the pixel memory 131*d* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second clock terminal.

In the first delay period (D1), the common voltage ($V_{com}$) and the data voltage ($V_{DATA}$) are constantly maintained prior to the first driving period (T1). The first delay period (D1) is a period that the gate voltage ($V_{GATE}$) is changed from low level to high level. This can assure clock skew margin or delay margin.

In the first driving period (T1), the gate voltage ($V_{GATE}$) of high level is applied to the pixel 131*a* and the pixel memory 131*d*, the common voltage ($V_{com}$) of low level and the data voltage ($V_{DATA}$) of high level are applied to the pixel 131*a*, and the first clock voltage of high level and the second clock voltage of low level are applied to the pixel memory 131*d*.

The pixel switching element (PS) of the pixel 131*a* is turned on by applying the gate voltage ($V_{GATE}$) of high level. The pixel switching element (PS) is turned on so as to transfer the data voltage ($V_{DATA}$) of high level applied from the first electrode to the pixel electrode ($V_{LC}$). Here, across the liquid crystal (LC) cell and the capacitive element ($C_{st}$) the data voltage ($V_{DATA}$) of high level is applied via the pixel electrode ($V_{LC}$), and the common voltage ($V_{com}$) of low level is applied via the common electrode (Vcom). As the result thereof, the liquid crystal (LC) cell controls a light transmission rate by changing an array state of liquid crystal cells according to horizontal electric field formed by a voltage difference between both electrodes in order to realize a gray level, and the capacitive element ($C_{st}$) stores the voltage difference between the pixel electrode ($V_{LC}$) and the common electrode (Vcom).

The first transmission gate (TM1) of the pixel memory 131*d* is turned on by applying the first clock voltage of high level to the first clock terminal and applying the first negative clock voltage of low level to the second clock terminal, so that the data voltage ($V_{DATA}$) of high level applied to the pixel electrode ($V_{LC}$) is applied to the second electrode of the memory switching element (MS). The memory switching element (MS) is turned off by applying the gate voltage ($V_{GATE}$) of high level.

In the second delay period (D2), the gate voltage ($V_{GATE}$) of low level is applied to the pixel 131*a* and the pixel memory 131*d*, and the first clock voltage of high level and the second clock voltage of low level are applied to the pixel memory 131*d*. The pixel 131*a* is turned off by applying the gate voltage ($V_{GATE}$) of low level to the control electrode of the pixel switching element (PS).

The pixel memory 131*d* is turned on by applying the gate voltage ($V_{GATE}$) of low level to the control electrode of the memory switching element (MS). The first transmission gate (TM1) of the pixel memory 131*d* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second clock terminal.

The memory switching element (MS) and the first transmission gate (TM1) of the pixel memory 131*d* are turned on, so that the data voltage ($V_{DATA}$) of high level applied to the pixel electrode ($V_{LC}$) is applied to a second input terminal of the first NOR gate (NOR1) to output the voltage of low level. The second NOR gate (NOR2) receives the voltage of low level to output the voltage of high level and apply the outputted voltage to the first NOR gate (NOR1). In other words, the voltage between the first NOR gate (NOR1) and the second NOR gate (NOR2) are changed between low level and high level alternately. The pixel voltage of high level outputted to the output terminal of the second NOR gate (NOR2) is outputted to the pixel electrode ($V_{LC}$).

Here, the second clock voltage is applied to the common electrode (Vcom) by electrically coupling to the second clock line (CLK2) with the same voltage value of low level as the common voltage ($V_{com}$) in the first delay period (D1). The pixel voltage of high level is applied to the pixel electrode ($V_{LC}$) and the second clock voltage of low level is applied to the common electrode (Vcom). The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. When the pixel 131*a* is turned off, the common voltage and the data voltage are not applied to the pixel 131*a*, and the liquid crystal (LC) cell is operated by the pixel memory 131*b*. The liquid crystal (LC) cell of the pixel 131*a* can be operated without applying the common voltage and the data voltage, thereby allowing the power consumption of the module operating the driver to be reduced. Accordingly, total power consumption of the LCD can be reduced. After the second delay period (D2), the pixel 131*a* is not operated and the liquid crystal (LC) cell is operated while outputting a voltage to be applied to the pixel electrode ($V_{LC}$) from the pixel memory 131*d*. The second delay period (D2) is a period of inputting and outputting the voltage from the pixel electrode ($V_{LC}$) to the pixel memory 131*d*.

In the second driving period (T2), the gate voltage ($V_{GATE}$) of low level through the gate line is applied to the pixel 131*a* and the pixel memory 131*d*, and the first clock voltage of low level through the first clock line (CLK1) and the second clock voltage of high level through the second clock line (CLK2) are applied to the pixel memory 131*d*. Here, the pixel switching element (PS) of the pixel 131*a* is turned off by applying the gate voltage ($V_{GATE}$) of low level to the control electrode, and thus the pixel 131*a* is not operated.

The memory switching element (MS) of the pixel memory 131*d* is turned on by applying the gate voltage ($V_{GATE}$) of low level to the control electrode. The first transmission gate (TM1) of the pixel memory 131*d* is turned off by applying the first clock voltage of low level to the first clock terminal and applying the first negative clock voltage of high level to the second clock terminal. The second transmission gate (TM2) is turned on by applying the second clock voltage of high level to the first clock terminal and applying the second negative clock voltage of low level to the second clock terminal. The second transmission gate (TM2) of the pixel memory 131*d* is turned on to output the pixel voltage of low level outputted to the output terminal of the first NOR gate (NOR1) to the pixel electrode ($V_{LC}$) through the second transmission gate (TM2) while the voltage between the first NOR gate (NOR1) and the second NOR gate (NOR2) is changed between low level and high level. The memory switching element (MS) of the pixel memory 131*d* is turned on. Accordingly, voltage between the first NOR gate (NOR1) and the second NOR gate (NOR2) are continuously alternated between low level and high level. In other words, the pixel voltage of low level is applied to the second input terminal of the second NOR gate (NOR2) so as to output the pixel voltage of high level and apply the outputted pixel voltage to the first NOR gate (NOR1). The first NOR gate (NOR1) outputs the pixel voltage of low level by receiving the pixel voltage of high level and applies the outputted pixel voltage to the second NOR gate (NOR2).

Here, the common electrode (Vcom) is electrically coupled to the second clock line (CLK2) with the same voltage value as the common voltage ($V_{com}$) in the first delay period (D1), the first driving period (T1) and the second delay period (D2) so as to apply the second clock voltage. The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. The second driving period (T2) is a period for outputting the voltage from the pixel memory 131*b* to the pixel electrode ($V_{LC}$).

Finally, in the third driving period (T3), the gate voltage ($V_{GATE}$) of low level through the gate line is applied to the pixel 131*a* and the pixel memory 131*b*, and the first clock voltage of high level through the first clock line (CLK1) and the second clock voltage of low level through the second clock line (CLK2) are applied to the pixel memory 131*d*. Here, the pixel switching element (PS) of the pixel 131*a* is turned off by applying the gate voltage ($V_{GATE}$) of low level to the control electrode, and thus the pixel 131*a* is not operated.

The memory switching element (MS) of the pixel memory 131*d* is turned on by applying the gate voltage ($V_{GATE}$) of low level to the control electrode. The first transmission gate (TM1) of the pixel memory 131*d* is turned on by applying the first clock voltage of high level to the first clock terminal and applying the first negative clock voltage of low level to the second clock terminal. The second transmission gate (TM2) is turned off by applying the second clock voltage of low level to the first clock terminal and applying the second negative clock voltage of high level to the second clock terminal. The first transmission gate (TM1) of the pixel memory 131*d* is turned on to output the pixel voltage of high level outputted to the output terminal of the second NOR gate (NOR2) to the pixel electrode ($V_{LC}$) through the first transmission gate (TM1) while the voltage between the first NOR gate (NOR1) and the second NOR gate (NOR2) are changed between low level and high level. The memory switching element (MS) of the pixel memory 131*d* is turned on. Accordingly, the voltage between the first NOR gate (NOR1) and the second NOR gate (NOR2) are continuously alternated between low level and high level are. In other words, the pixel voltage of high level is applied to the second input terminal of the first NOR gate (NOR1) so as to output the pixel voltage of low level and apply the outputted pixel voltage to the second NOR gate (NOR2). The second NOR gate (NOR2) outputs the pixel voltage of high level by receiving the pixel voltage of low level and applies the outputted pixel voltage to the first NOR gate (NOR1).

Here, the common electrode (Vcom) is electrically coupled to the second clock line (CLK2) with the same voltage value as the common voltage ($V_{com}$) in the first delay period (D1), the first driving period (T1), the second delay period (D2) and the third driving period (T3) so as to apply the second clock voltage of low level. The pixel voltage of high level is applied to the pixel electrode ($V_{LC}$) and the second clock voltage of low level is applied to the common electrode (Vcom). The liquid crystal (LC) cell controls the light transmission rate by changing the array state of liquid crystal cells according to horizontal electric field formed by the voltage difference between the pixel electrode ($V_{LC}$) and the common electrode (Vcom) in order to realize the gray level. The third driving period (T3) is a period for outputting the voltage from the pixel memory 131*d* to the pixel electrode ($V_{LC}$).

Referring to FIG. 8*b*, the timing chart of the pixel 131*a* and the pixel memory 131*d* includes the first driving period (T1), the second driving period (T2) and the third driving period (T3), and additionally may include the first delay period (D1) and the second delay period (D2). Comparing the timing chart of FIG. 8*b* to the timing chart of FIG. 8*a*, the voltage applied from the pixel electrode ($V_{LC}$) is changed from low level to high level and from high level to low level (i.e., reversed). Additionally, the voltage applied from the common electrode (Vcom) is changed from high level to low level and from low level to high level (i.e., reversed). The pixel 131*a* is turned off, and thus when the pixel memory 131*d* is inputted and outputted, the pixel voltages applied to the pixel memory 131*d* are sequentially changed, and the common voltage applied to the liquid crystal (LC) cell of the pixel 131*a* is changed from the second clock voltage applied through the second clock line (CLK2) to the first clock voltage applied through the first clock line (CLK1). In other words, each operation of the pixel 131*a* and the pixel memory 131*d* is the same in FIGS. 8*a* and 8*b* except that the timing and the voltage level are changed.

As described above, the liquid crystal display according to embodiments of the present invention produces the following effects.

First, the pixel voltage is stored in the memory (e.g., 131*b*, 131*c* and 131*d*) when the still image in the OSD region of the panel is displayed for a long period of time, thereby allowing the power consumption to be reduced by driving the LCD using the voltage stored in the memory.

Second, using the transmission gate (e.g., TM1 and TM2) as the input/output switching element of the pixel memory instead of using single thin film transistor, the image deterioration can be improved by preventing or reducing the voltage drop across the switching element.

It should be understood by those of ordinary skill in the art that various placements, modifications and changes in the form and details may be made therein without departing from the spirit and scope of the present invention as defined by the following claims. Therefore, it is to be appreciated that the above described embodiments are for purposes of illustration only and are not to be construed as limitations of the invention.

What is claimed is:

1. A liquid crystal display comprising a data driver, a gate driver and a liquid crystal display panel having a plurality of pixels and a plurality of pixel memories, each of the plurality of pixel memories comprising:

a first inverter having a first input terminal and a first output terminal, the first inverter configured to output a first output voltage;

a second inverter having a second input terminal and a second output terminal, the second inverter configured to receive the first output voltage and output a second output voltage opposite to the first output voltage;

a memory switching element comprising a first electrode electrically coupled to the first input terminal of the first inverter, and a second electrode electrically coupled to the second output terminal of the second inverter;

a first transmission gate electrically coupled between the memory switching element and a pixel electrode; and a second transmission gate electrically coupled between the first output terminal of the first inverter and the pixel electrode, wherein the second transmission gate is configured to transfer a pixel voltage applied from the pixel electrode to the second input terminal.

2. The liquid crystal display of claim 1, wherein the first output terminal is electrically coupled to the second input terminal of the second inverter and a first electrode of the second transmission gate.

3. The liquid crystal display of claim 2, wherein the first inverter is configured to output the first output voltage opposite to a voltage received from the memory switching element so as to transfer the first output voltage to the second input terminal and the first electrode of the second transmission gate.

4. The liquid crystal display of claim 1, wherein the second input terminal is electrically coupled to the first output terminal and the first electrode of the second transmission gate, and the second output terminal is electrically coupled to a first electrode of the first transmission gate.

5. The liquid crystal display of claim 4, wherein the second inverter outputs the second output voltage opposite to a voltage received from the first inverter so as to transfer the second output voltage to the first electrode of the first transmission gate and the second electrode of the memory switching element.

6. The liquid crystal display of claim 4, wherein the second inverter outputs the second output voltage opposite to a voltage received from a first electrode of the second transmission gate so as to transfer the second output voltage to the second electrode of the memory switching element.

7. The liquid crystal display of claim 1, wherein the memory switching element further comprises a control electrode electrically coupled to a gate line, and wherein the second electrode is electrically coupled to a first electrode of the first transmission gate.

8. The liquid crystal display of claim 7, wherein the memory switching element is configured to turn on when a gate voltage of low level is applied to the control electrode through the gate line so as to transfer an output voltage from the first transmission gate to the first input terminal.

9. The liquid crystal display of claim 7, wherein the memory switching element is configured to turn on when a gate voltage of low level is applied to the control electrode through the gate line so as to transfer the second output voltage to the first input terminal.

10. The liquid crystal display of claim 1, wherein the first transmission gate comprises:

a first electrode electrically coupled to the second electrode of the memory switching element and the second output terminal of the second inverter;

a first clock terminal electrically coupled to a first clock line;

a second clock terminal electrically coupled to a first negative clock line; and a second electrode electrically coupled to the pixel electrode.

11. The liquid crystal display of claim 10, wherein the first transmission gate is configured to turn on when a first clock voltage of high level is applied to the first clock terminal through the first clock line and a first negative clock voltage of low level is applied to the second clock terminal through the first negative clock line so as to transfer the pixel voltage applied from the pixel electrode to the memory switching element.

12. The liquid crystal display of claim 10, wherein the first transmission gate is configured to turn on when a first clock voltage of high level is applied to the first clock terminal through the first clock line and a first negative clock voltage of low level is applied to the second clock terminal through the first negative clock line so as to transfer the second output voltage to the pixel electrode.

13. The liquid crystal display of claim 1, wherein the second transmission gate comprises a first electrode electrically coupled to the first output terminal and the second input terminal, a first clock terminal electrically coupled to a second clock line, a second clock terminal electrically coupled to a second negative clock line, and a second electrode electrically coupled to the pixel electrode.

14. The liquid crystal display of claim 13, wherein the second transmission gate is configured to turn on when a second clock voltage of high level is applied to the first clock terminal through the second clock line and a second negative clock voltage of low level is applied to the second clock terminal through the second negative clock line so as to transfer the pixel voltage applied from the pixel electrode to the second input terminal.

15. The liquid crystal display of claim 13, wherein the second transmission gate is configured to turn on when a second clock voltage of high level is applied to the first clock terminal through the second clock line and a second negative clock voltage of low level is applied to the second clock terminal through the second negative clock line so as to transfer the first output voltage to the pixel electrode.

16. The liquid crystal display of claim 1, each of the plurality of pixels comprising:

a liquid crystal cell having a first electrode electrically coupled to the pixel electrode and a second electrode electrically coupled to a common electrode;

a capacitive element electrically coupled between the pixel electrode and the common electrode; and a pixel switching element electrically coupled between the pixel electrode and a data line, and having a control electrode electrically coupled to a gate line.

17. The liquid crystal display of claim 16, wherein the first electrode of the liquid crystal cell is electrically coupled to a second electrode of the first transmission gate and a second electrode of the second transmission gate via the pixel electrode, and the second electrode of the liquid crystal cell is electrically coupled to the common electrode.

18. The liquid crystal display of claim 16, wherein the first electrode of the liquid crystal cell comprises the pixel electrode, and the second electrode of the liquid crystal cell comprises the common electrode.

19. The liquid crystal display of claim 16, wherein the capacitive element comprises:

a first electrode electrically coupled to a second electrode of the first transmission gate, a second electrode of the second transmission gate, and the first electrode of the liquid crystal cell; and a second electrode electrically coupled to the common electrode and the second electrode of the liquid crystal cell.

20. The liquid crystal display of claim 19, wherein the capacitive element is configured to store an amount of charge corresponding to a voltage difference between the first electrode of the capacitive element and the second electrode of the capacitive element.

21. The liquid crystal display of claim 16, wherein the pixel switching element comprises the control electrode electrically coupled to the gate line, a first electrode electrically coupled to the data line, and a second electrode electrically coupled to the pixel electrode, the first electrode of the capacitive element and the first electrode of the liquid crystal cell.

22. The liquid crystal display of claim 21, wherein the pixel switching element is configured to turn on when a gate voltage of high level is applied to the control electrode through the gate line so as to transfer a data voltage applied from the data line to the pixel electrode.

23. The liquid crystal display of claim 16, wherein the memory switching element is configured to turn off when the pixel switching element is turned on, and the memory switching element is configured to turn on when the pixel switching element is turned off.

24. A liquid crystal display comprising a data driver, a gate driver and a liquid crystal display panel having a plurality of pixels and a plurality of pixel memories, each of the plurality of pixel memories comprising:

a first NOR gate having a first input terminal electrically coupled to a ground and configured to output a first output voltage opposite to a first input voltage received at its second input terminal;

a second NOR gate having a first input terminal electrically coupled to the ground and configured to receive the first output voltage at its second input terminal to output a second output voltage opposite to the first output voltage to its output terminal;

a memory switching element comprising a first electrode electrically coupled to the second input terminal of the first NOR gat; and a second electrode electrically coupled to the output terminal of the second NOR gate;

a first transmission gate electrically coupled between the memory switching element and a pixel electrode; and a second transmission gate electrically coupled between the pixel electrode and an output terminal of the first NOR gat, wherein the second transmission gate is configured to transfer a pixel voltage applied from the pixel electrode to the second input terminal of the second NOR gate.

25. The liquid crystal display of claim 24, wherein the first NOR gate comprises the first input terminal electrically coupled to the ground, and the output terminal electrically coupled to the second input terminal of the second NOR gate and a first electrode of the second transmission gate.

26. The liquid crystal display of claim 24, wherein the second NOR gate comprises the first input terminal electrically coupled to the ground, the second input terminal electrically coupled to the output terminal of the first NOR gate and a first electrode of the second transmission gate, and the output terminal electrically coupled to a first electrode of the first transmission gate.

27. The liquid crystal display of claim 24, wherein the memory switching element comprises a control electrode electrically coupled to a gate line, and wherein the second electrode is electrically coupled to a first electrode of the first transmission gate.

28. The liquid crystal display of claim 24, wherein the first transmission gate comprises a first electrode electrically coupled to the second electrode of the memory switching element and the output terminal of the second NOR gate, a first clock terminal electrically coupled to a first clock line, a second clock terminal electrically coupled to a first negative clock line, and a second electrode electrically coupled to the pixel electrode.

29. The liquid crystal display of claim 24, wherein the second transmission gate comprises a first electrode electrically coupled to the output terminal of the first NOR gate and the second input terminal of the second NOR gate, a first clock terminal electrically coupled to a second clock line, a second clock terminal electrically coupled to a second negative clock line, and a second electrode electrically coupled to the pixel electrode.

30. The liquid crystal display of claim 24, each of the plurality of pixels comprising:

a liquid crystal cell having a first electrode electrically coupled to the pixel electrode and a second electrode electrically coupled to a common electrode;

a capacitive element electrically coupled between the pixel electrode and the common electrode; and a pixel switching element electrically coupled between the pixel electrode and a data line, and configured to electrically couple a control electrode to a gate line.

* * * * *

UNITED STATES PATENT AND TRADEMARK OFFICE

CERTIFICATE OF CORRECTION

PATENT NO. : 8,400,388 B2
APPLICATION NO. : 12/052478
DATED : March 19, 2013
INVENTOR(S) : Junghwan Kim It is certified that error appears in the above-identified patent and that said Letters Patent is hereby corrected as shown below:

In the Claims

| | |
|---|---|
| Column 32, Claim 24, line 54 | Delete "gat;"<br>Insert -- gate; -- |
| Column 32, Claim 24, line 60 | Delete "gat;"<br>Insert -- gate; -- |

Signed and Sealed this
First Day of July, 2014

Michelle K. Lee

Michelle K. Lee
*Deputy Director of the United States Patent and Trademark Office*